US010955798B2

(12) United States Patent
Nojima

(10) Patent No.: US 10,955,798 B2
(45) Date of Patent: Mar. 23, 2021

(54) IMAGE FORMING APPARATUS

(71) Applicant: CANON KABUSHIKI KAISHA, Tokyo (JP)

(72) Inventor: Koji Nojima, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 204 days.

(21) Appl. No.: 16/009,724

(22) Filed: Jun. 15, 2018

(65) Prior Publication Data

US 2018/0292782 A1 Oct. 11, 2018

Related U.S. Application Data

(63) Continuation of application No. PCT/JP2016/089234, filed on Dec. 27, 2016.

(30) Foreign Application Priority Data

Dec. 28, 2015 (JP) ..... JP2015-255876
Dec. 15, 2016 (JP) ..... JP2016-243805

(51) Int. Cl.
*G03G 21/20* (2006.01)
*G03G 15/20* (2006.01)

(52) U.S. Cl.
CPC ..... *G03G 21/206* (2013.01); *G03G 15/2017* (2013.01)

(58) Field of Classification Search
CPC ..... G03G 15/2017; G03G 21/206
See application file for complete search history.

(56) References Cited

U.S. PATENT DOCUMENTS 7,452,645 B2 11/2008 Sugiura
7,512,355 B2 3/2009 Fujii et al.
8,554,104 B2 10/2013 Shimoyama et al.
9,068,693 B2 6/2015 Hatori et al.
9,141,085 B2 * 9/2015 Wachi ..... G03G 15/2017
9,152,097 B2 10/2015 Nojima et al.
9,256,201 B2 2/2016 Satou et al.
(Continued)

FOREIGN PATENT DOCUMENTS

CN 1755531 A 4/2006
CN 1766761 A 5/2006
(Continued)

OTHER PUBLICATIONS

International Search Report dated Mar. 27, 2017, in International Application No. PCT/JP2016/089234.
(Continued)

*Primary Examiner* — Walter L Lindsay, Jr.
*Assistant Examiner* — Geoffrey T Evans
(74) *Attorney, Agent, or Firm* — Venable LLP

(57) ABSTRACT

An image forming apparatus is capable of appropriately removing fine particles produced from a parting material contained in a toner. A distance d (mm) between an inlet port of a duct and a heating belt is Fs ($cm^2$), the area of a nonwoven fabric filter is Fs ($cm^2$), and the air passing speed of the air in the nonwoven fabric filter is Fv (cm/s) satisfy, $$(1.25 \times d - 8.67) \times \frac{1000}{Fv \times 60} \leq Fs < 200 \times \frac{1000}{Fv \times 60}.$$

18 Claims, 24 Drawing Sheets

(56) References Cited

U.S. PATENT DOCUMENTS

| | | | |
|---|---|---|---|
| 9,383,696 | B2 | 7/2016 | Nojima et al. |
| 9,411,275 | B2 | 8/2016 | Sugiyama et al. |
| 2011/0211860 | A1 | 9/2011 | Shimoyama et al. |
| 2012/0107011 | A1 | 5/2012 | Brown et al. |
| 2014/0056608 | A1 | 2/2014 | Miura |

FOREIGN PATENT DOCUMENTS

| | | | |
|---|---|---|---|
| CN | 103324056 | A | 9/2013 |
| CN | 103631119 | A | 3/2014 |
| CN | 103676578 | A | 3/2014 |
| CN | 105022251 | A | 11/2015 |
| EP | 2 725 431 | A1 | 4/2014 |
| JP | 7-114327 | A | 5/1995 |
| JP | 2000-061229 | A | 2/2000 |
| JP | 2006-285015 | A | 10/2006 |
| JP | 2010-002803 | A | 1/2010 |
| JP | 2010-117421 | A | 5/2010 |
| JP | 2011-140384 | A | 7/2011 |
| JP | 2011-180236 | A | 9/2011 |
| JP | 2013-190651 | A | 9/2013 |
| JP | 2014-044238 | A | 3/2014 |
| JP | 2014-142606 | A | 8/2014 |
| JP | 2015-184429 | A | 10/2015 |
| JP | 2015-219448 | A | 12/2015 |
| KR | 10-2006-0028226 | A | 3/2006 |

OTHER PUBLICATIONS

Extended European Search Report dated Jul. 23, 2019, in European Patent Application No. 16881851.6.

Office Action dated Sep. 3, 2019, issued in Japanese Patent Application No. 2016-243805.

Notice of Allowance dated May 22, 2019, in Korean Patent Application No. 10-2018-7020955.

Office Action dated Apr. 9, 2020, issued in Chinese Patent Application No. 201680076809.X.

* cited by examiner (a)

(b)

(a)

(b)

IMAGE FORMING APPARATUS

TECHNICAL FIELD

The present invention relates to an image forming apparatus for forming a toner image on a recording material. This image forming apparatus is used as a copying machine, a printer, a facsimile machine, a multifunction machine having a plurality of functions of these machines, and the like.

BACKGROUND ART

An electrophotographic image forming apparatus forms an image on the recording material using toner containing a parting material. In addition, the image forming apparatus includes a fixing device which heats and presses the recording material bearing the toner image and fixes the image on the recording material.

The image forming apparatus described in JP-A-2013-190651 has a structure for collecting ultrafine particles produced by heating a toner containing a parting material.

However, with this structure, there is room for improvement in properly removing produced microparticles.

SUMMARY OF THE INVENTION

An object of the present invention is to provide an image forming apparatus capable of appropriately removing fine particles produced from a parting material contained in the toner.

Means for Solving the Problem

The present invention provides

An image forming apparatus comprising an image forming portion for forming an image on a recording material using toner containing parting material; a heating rotatable member and a pressing rotatable member forming a nip portion for fixing the image formed on the recording material by said image forming portion; a duct for discharging the air taken in from neighborhood of an entrance of the nip portion through an air inlet port; a filter provided in an air flow path to collect fine particles produced from the parting material; a fan for sucking air into said duct; a distance between the air inlet port and said heating rotatable member is d (mm), an area of said filter is Fs (cm^2), and an air flow speed in the filter is Fv (cm/s) satisfy the following:

$$(1.25\times d-8.67)\times\frac{1000}{Fv\times 60}\leq Fs<200\times\frac{1000}{Fv\times 60}$$

Effect of the Invention

According to the present invention, it is possible to properly remove fine particles produced from the parting material contained in the toner.

Figure 6:
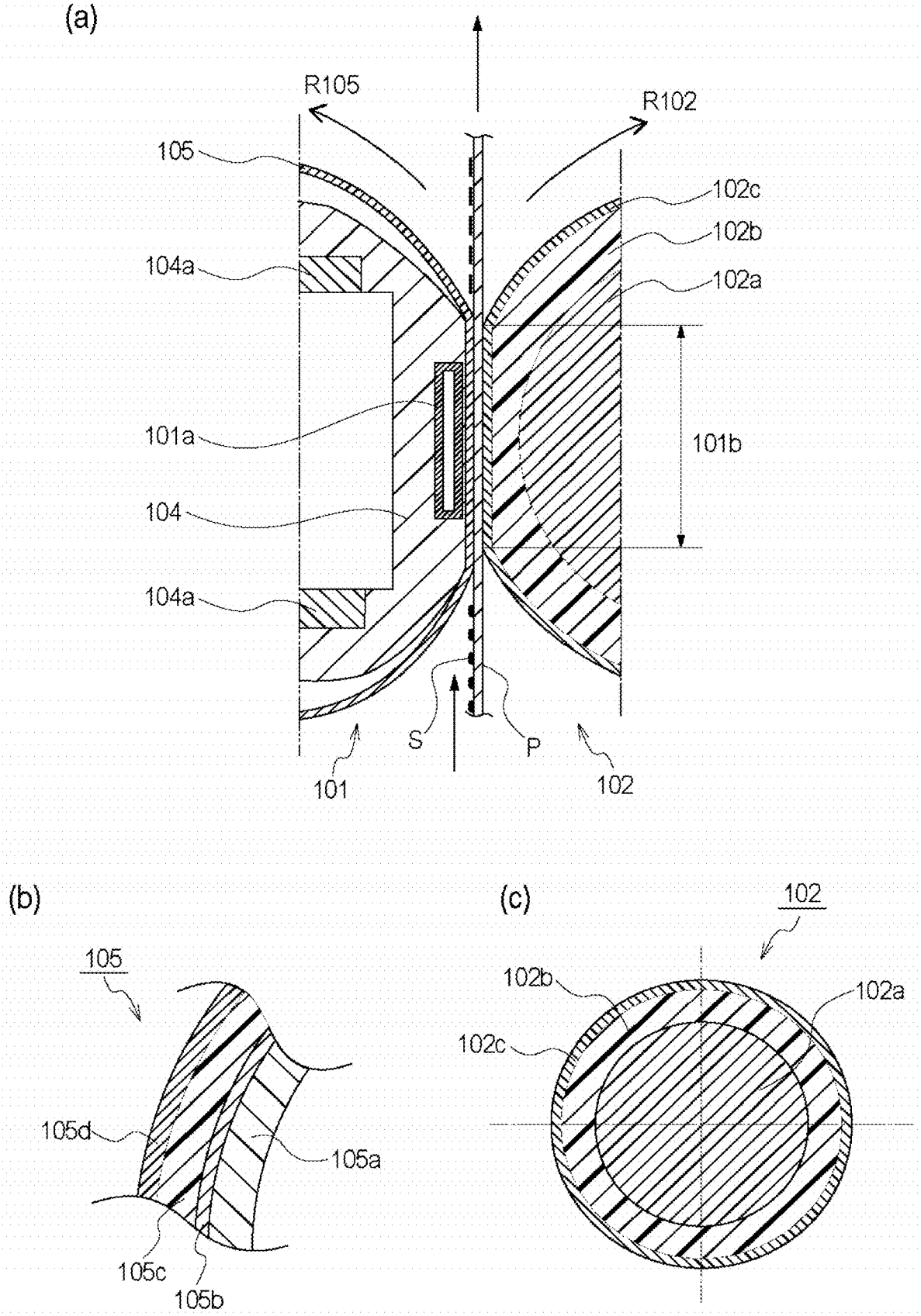

Part (a) of FIG. 6 is a view showing a sheet in the neighborhood of the nip portion of the fixing unit, FIG. 6 (*b*) shows a layer structure of the belt, and part (c) of FIG. 6 shows a layer structure of the pressure roller.

Figure 7:
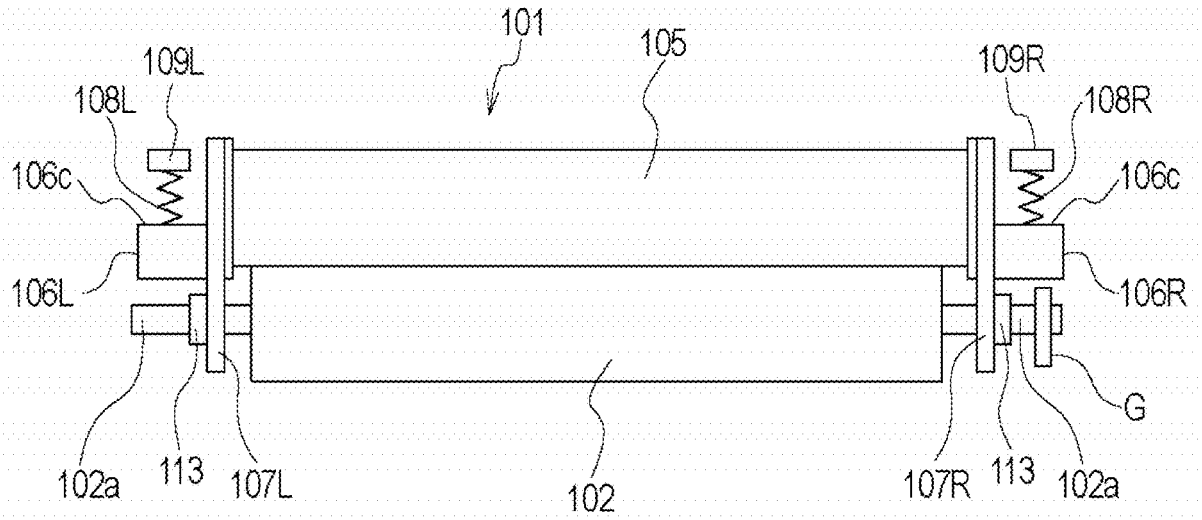

FIG. 7 is an illustration of a pressing mechanism for the belt unit.

Figure 8:
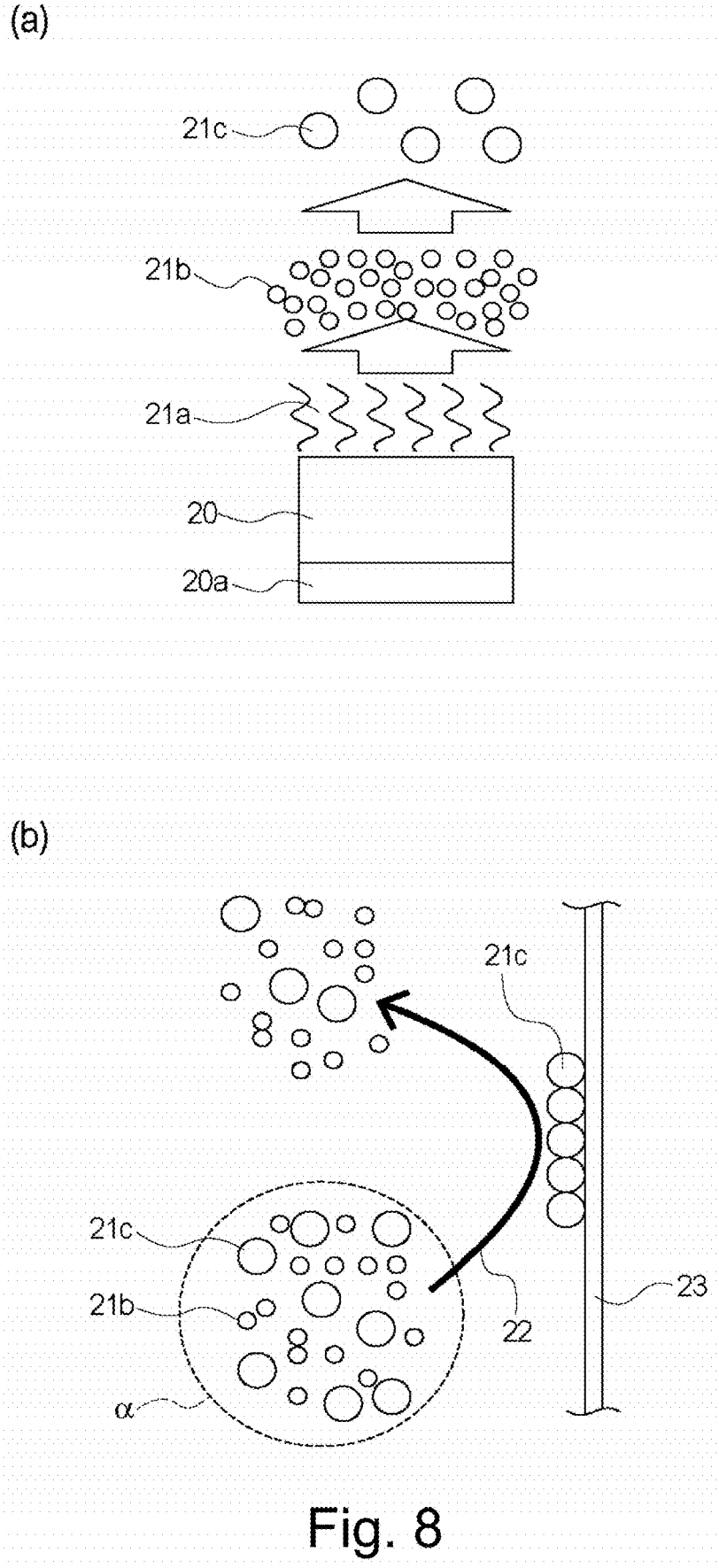

In FIG. 8, part (a) is a view illustrating a coalescence phenomenon—of the dust D, and part (b) is a schematic view illustrating deposition phenomenon—of the dust D.

Figure 9:
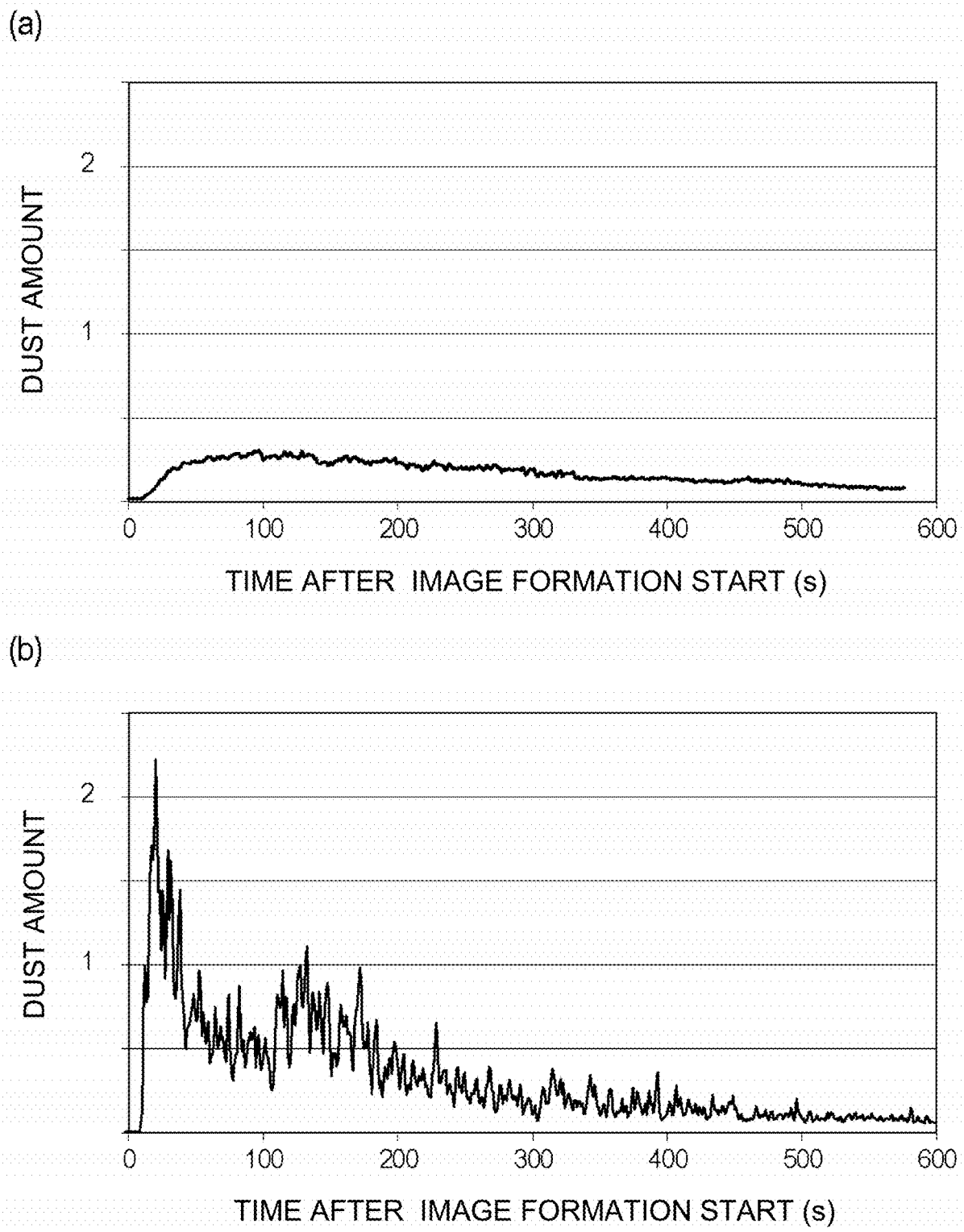

Part (a) of FIG. 9 is a graph showing the relationship between the elapsed time of the image forming process and the amount of produced dust D in verification example 1, part (b) thereof is a graph showing the relationship between the elapsed time of the image forming process in verification example 2 and the dust production amount.

Figure 10:
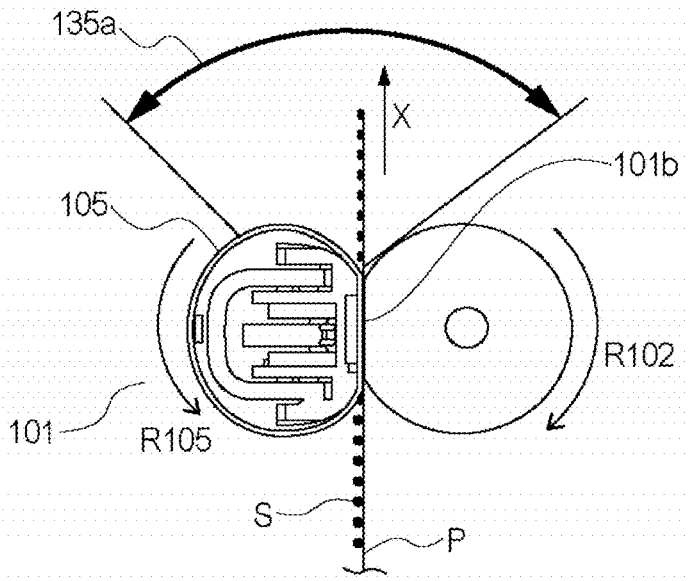
Figure 10:
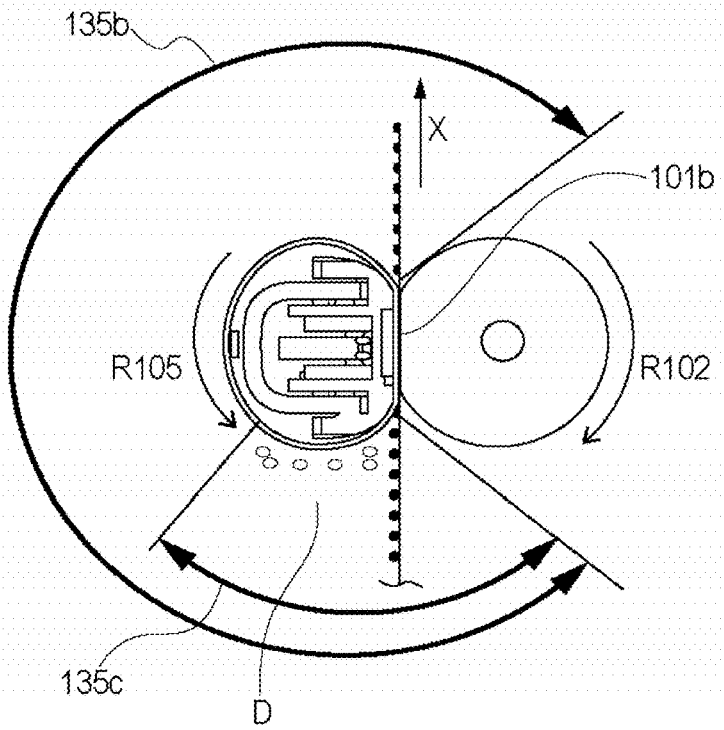
Figure 11:
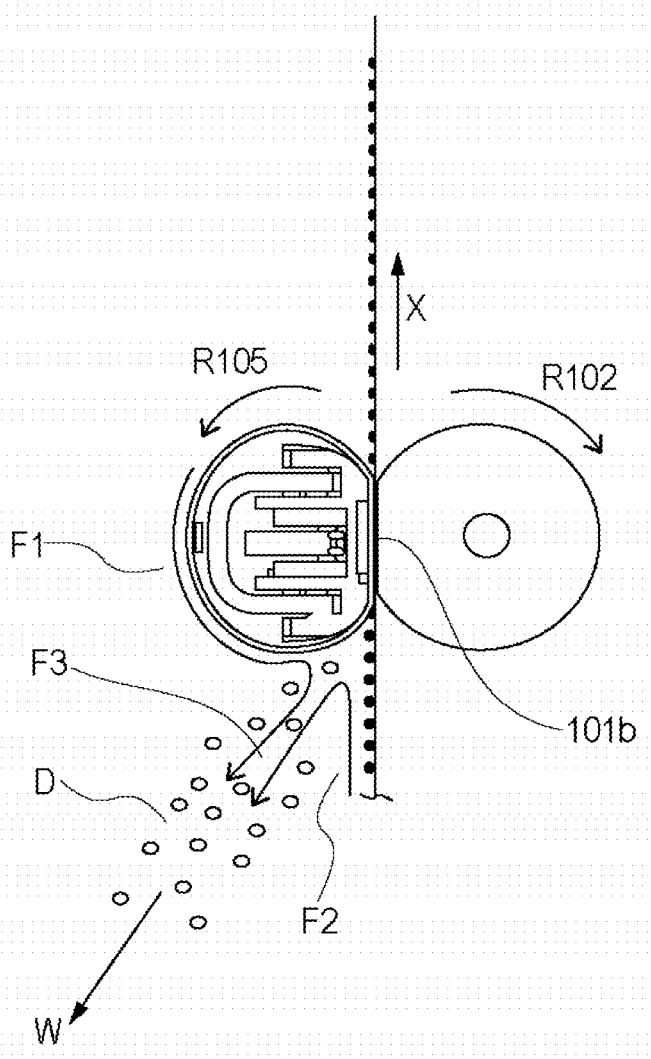

Part (a) of FIG. 10 shows a state of a wax adhering region on the fixing belt which expands with the progress of the fixing process, and part (b) shows the relationship between the deposition region of the wax and the production region of the dust D FIG. 11 is an illustration of air flow around the fixing belt.

Figure 12:
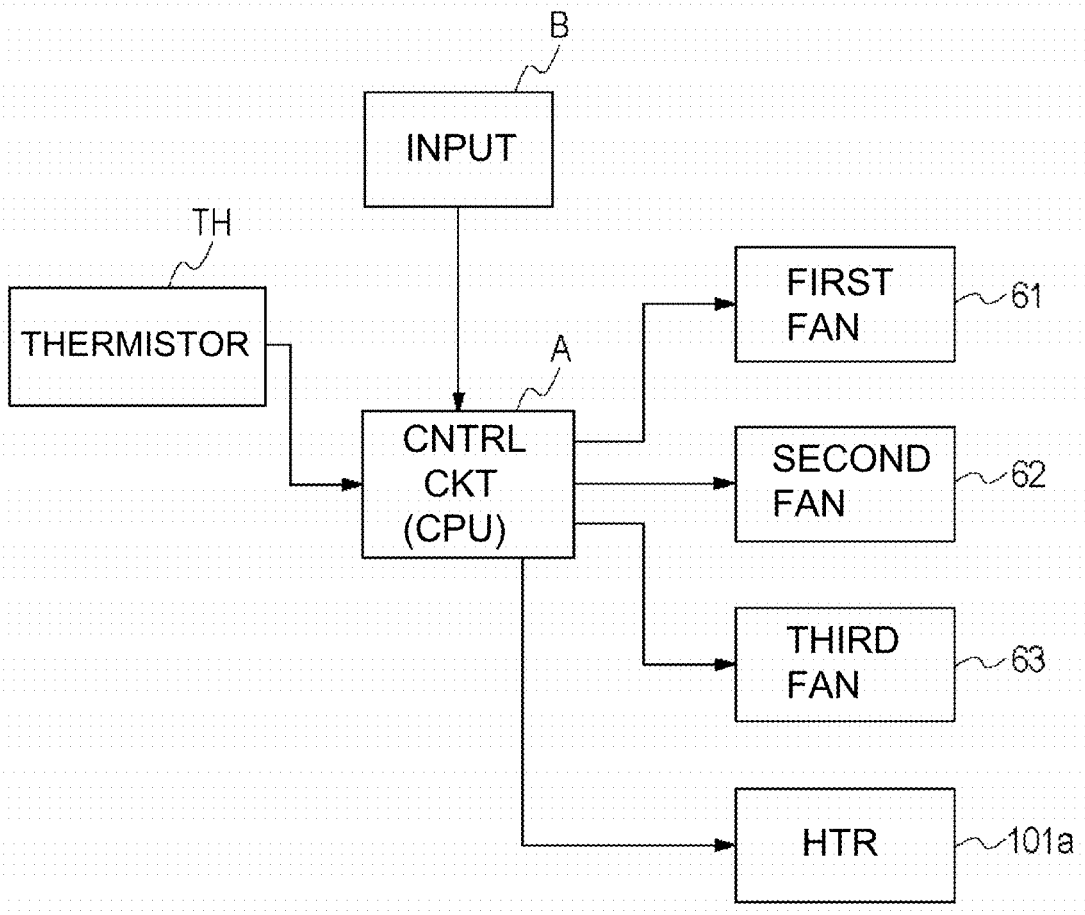

FIG. 12 is a diagram showing the relationship between the control circuit and each component.

Figure 13:
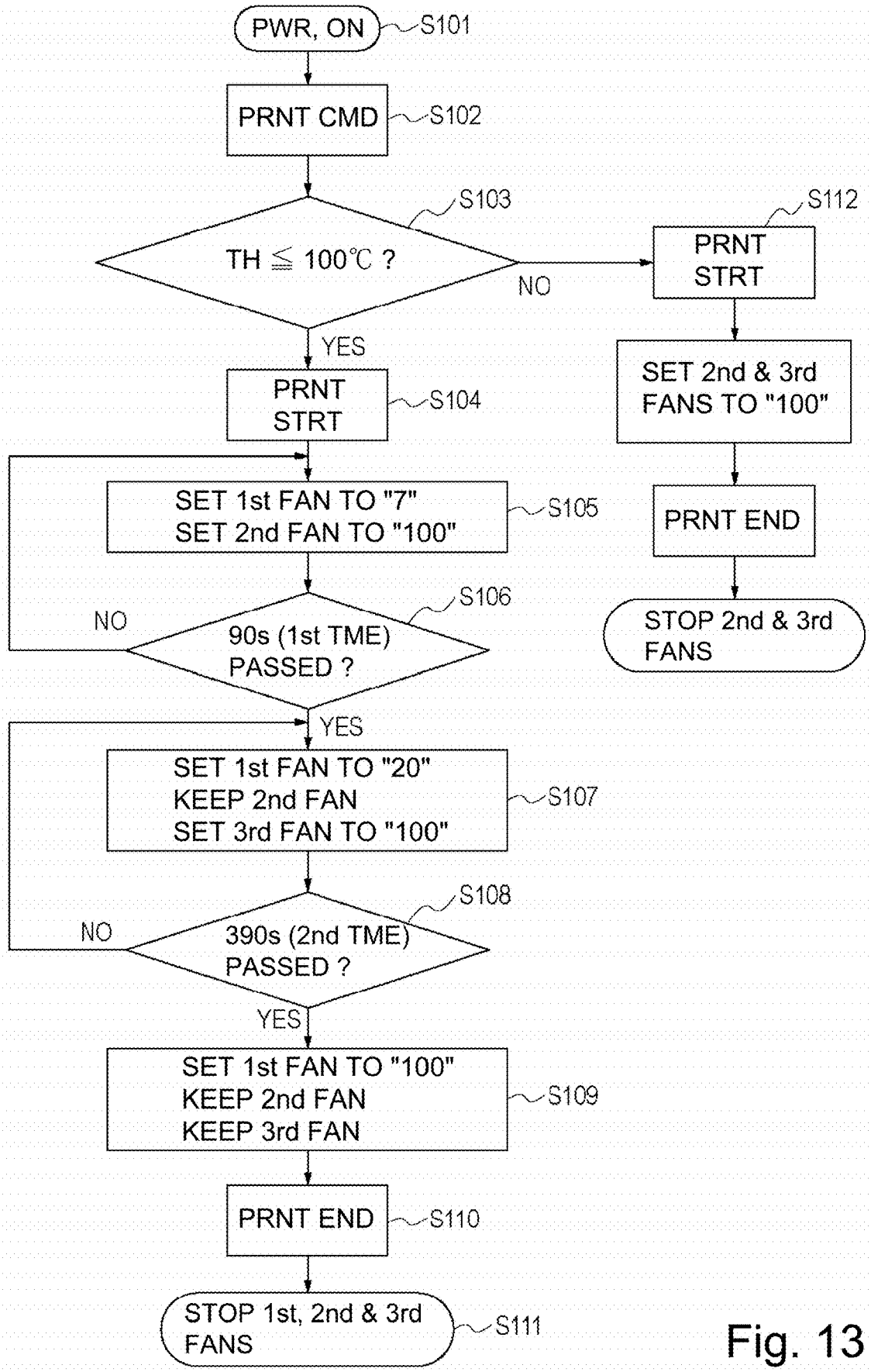

FIG. 13 is a flowchart illustrating the control of a fan.

Figure 14:
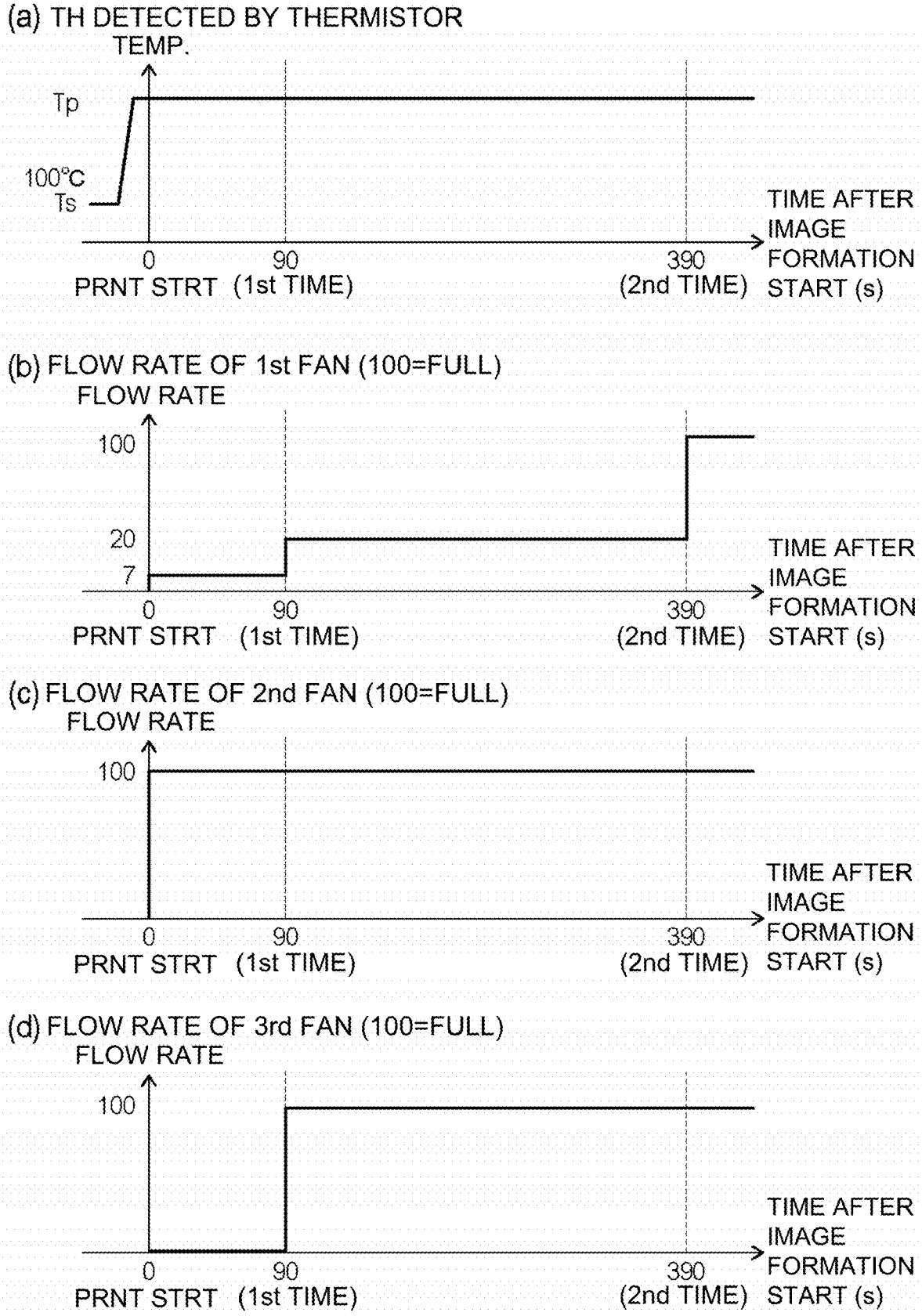

FIG. 14 (*a*) is a sequence diagram of the thermistor TH, part (b) is a sequence diagram of a first fan, part (c) is a sequence diagram of a second fan, and part (d) is a sequence diagram of a third fan.

Figure 15:
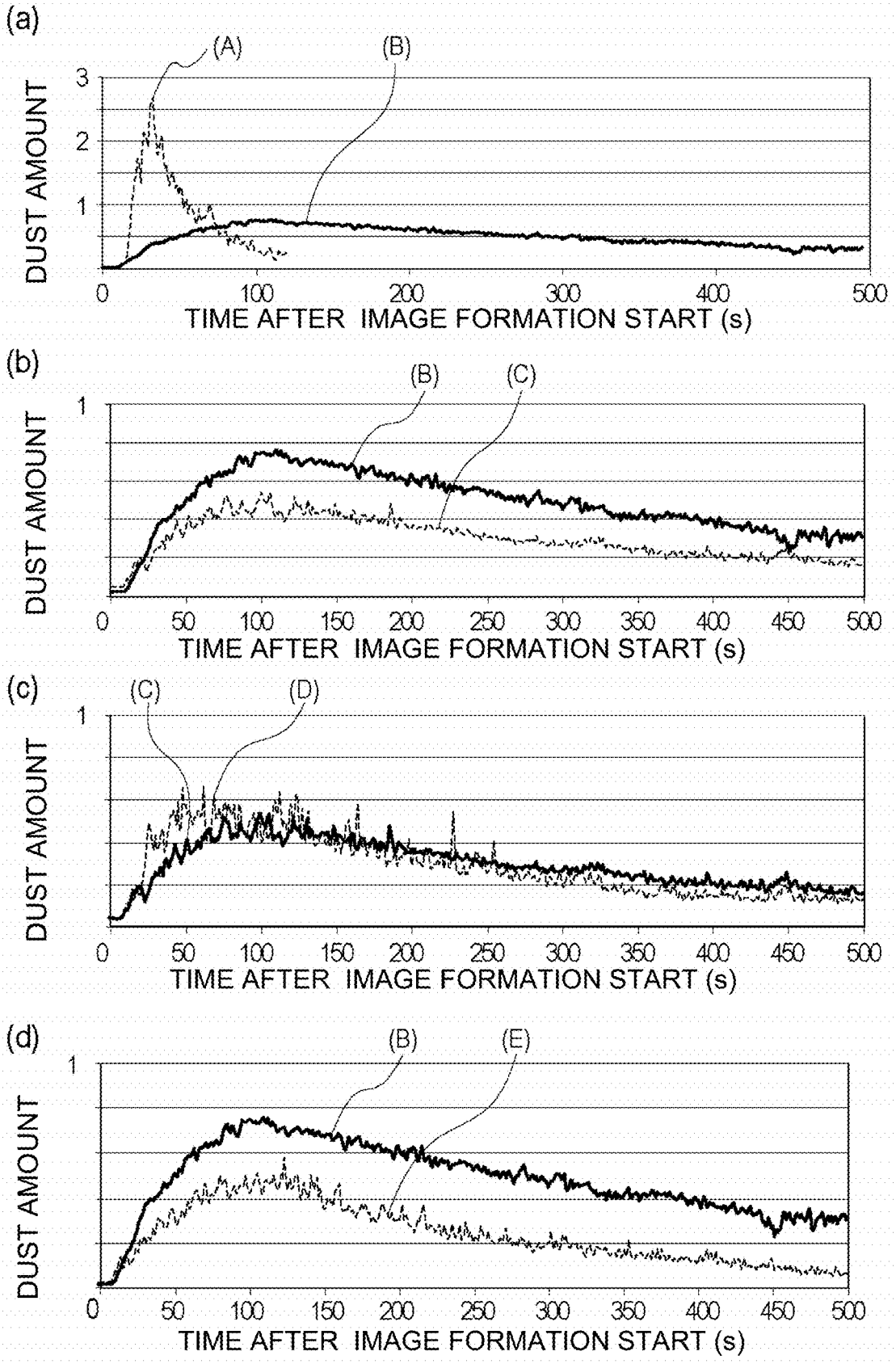

Part (a) of FIG. 15 is a first graph showing an effect of an air flow rate control, part (b) is a second graph showing an effect of the air flow rate control, and part (c) is a graph showing an effect of the air flow rate control 3, and part (d) is a fourth graph illustrating an effect of the air flow rate control.

Figure 16:
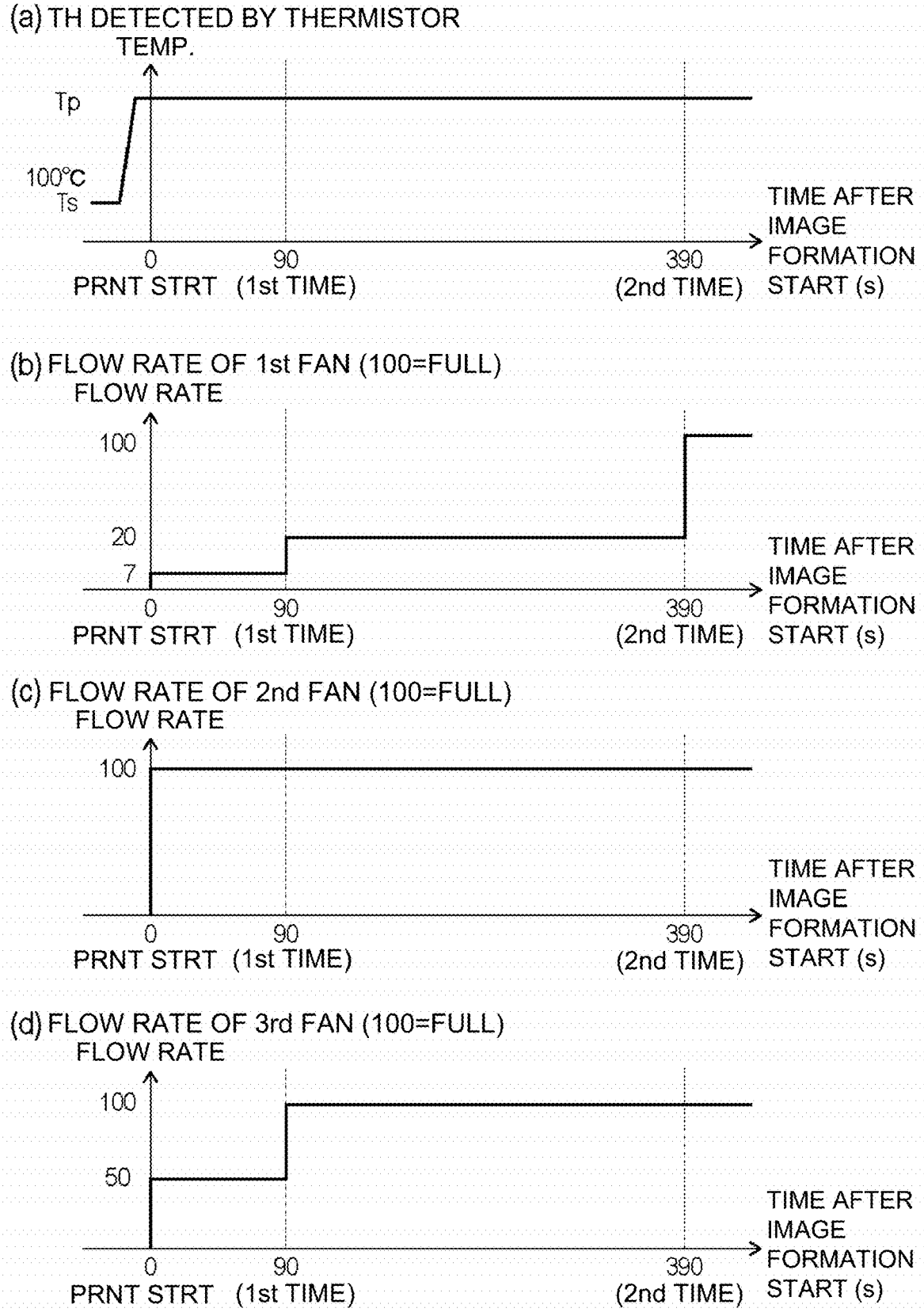

In FIG. 16, part (a) is a sequence diagram of a thermistor, part (b) is a sequence diagram of the first fan, part (c) is a sequence diagram of the second fan, and part (d) is a sequence diagram of the third fan.

Figure 17:
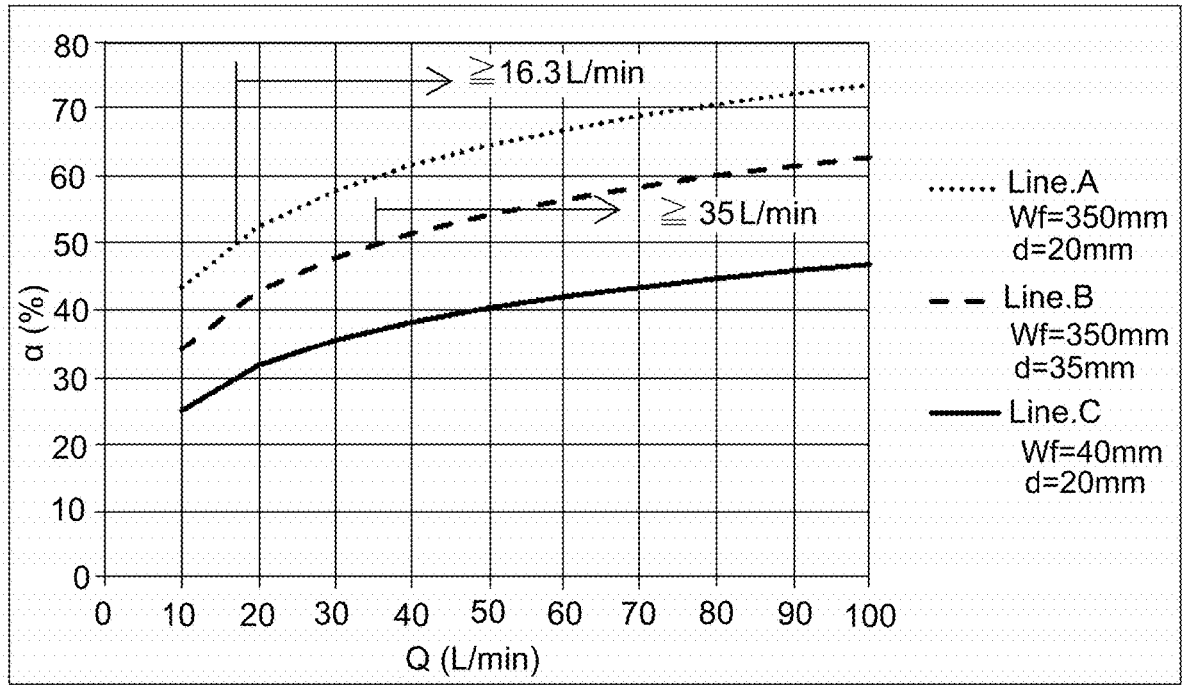
Figure 17:
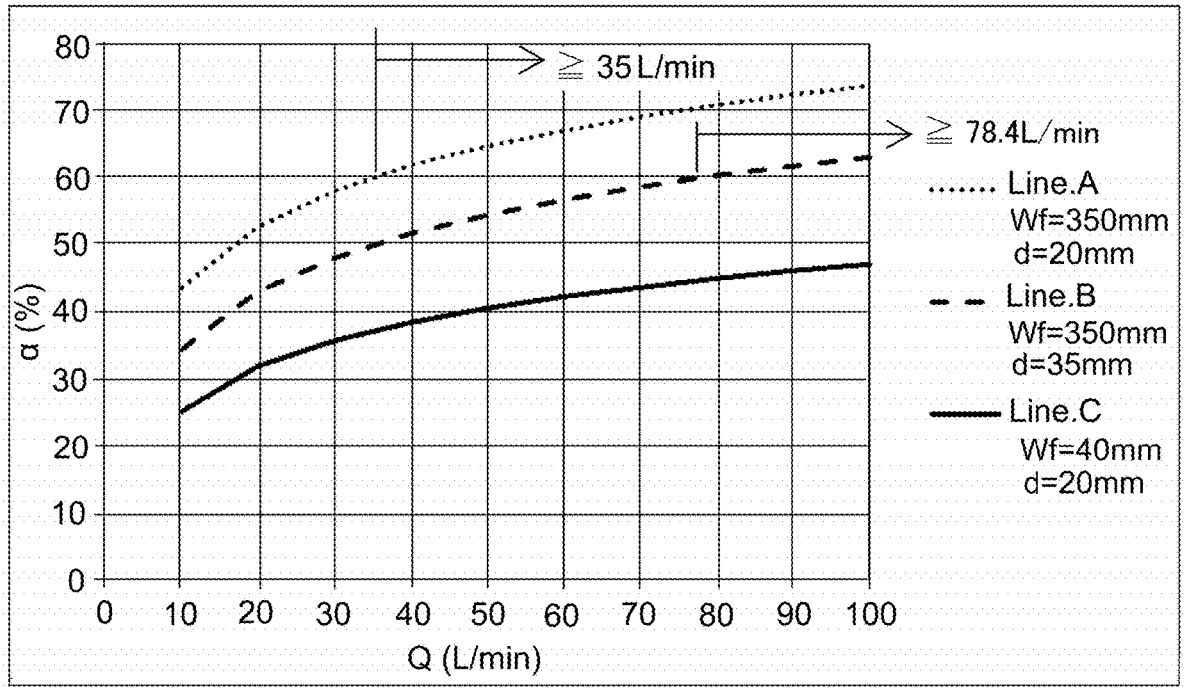

In FIG. 17, part (a) is a graph showing a suction air flow rate Q (L/min) necessary when a target value of a dust reduction rate α is set to 50%, part (b) shows the target value of the dust reduction rate α (L/min) required when the air flow rate is set to 60%.

Figure 18:
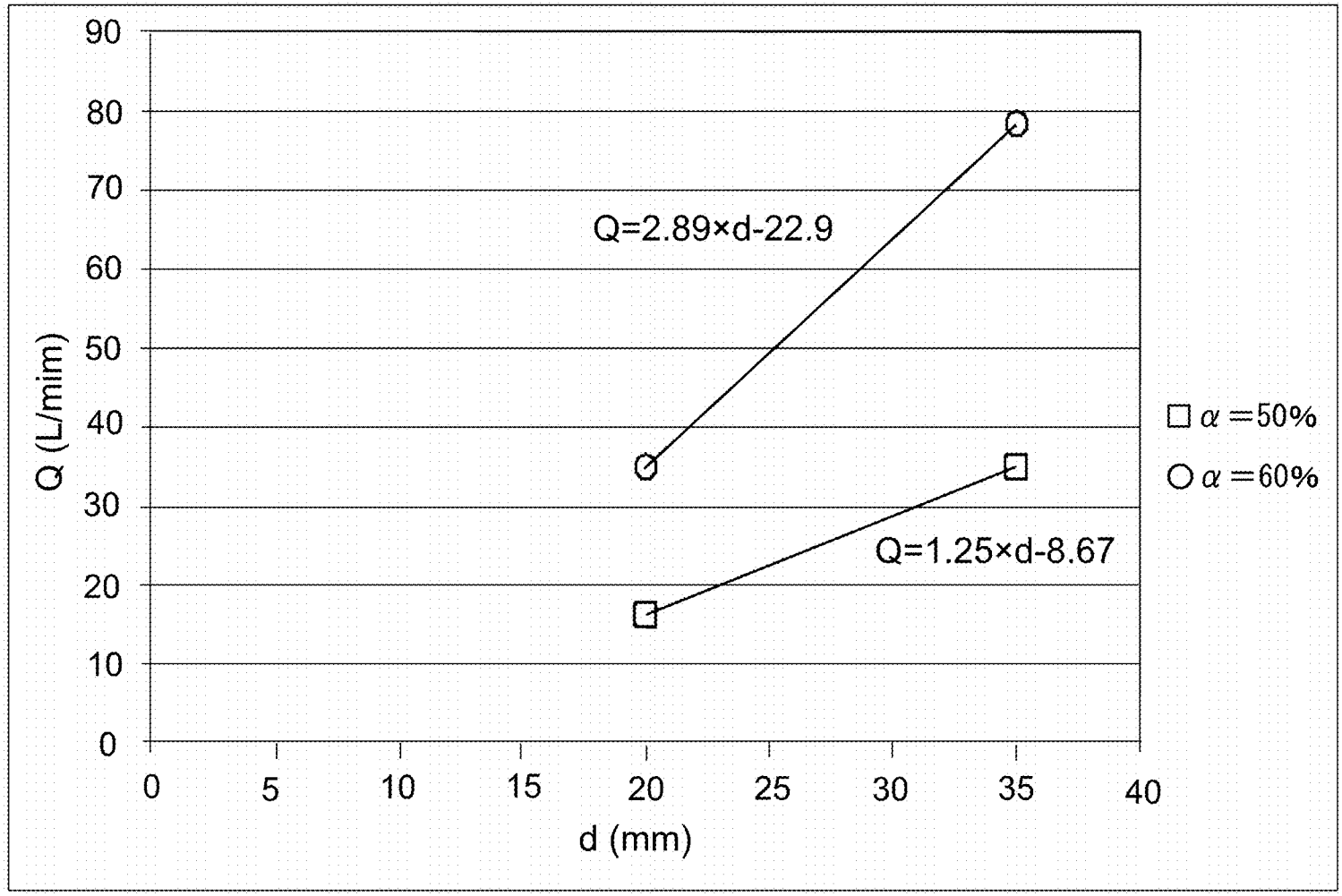

FIG. 18 is a graph showing the relationship between the distance d (mm) between the belt surface and the filter and the suction air flow rate Q (L/min).

Figure 19:
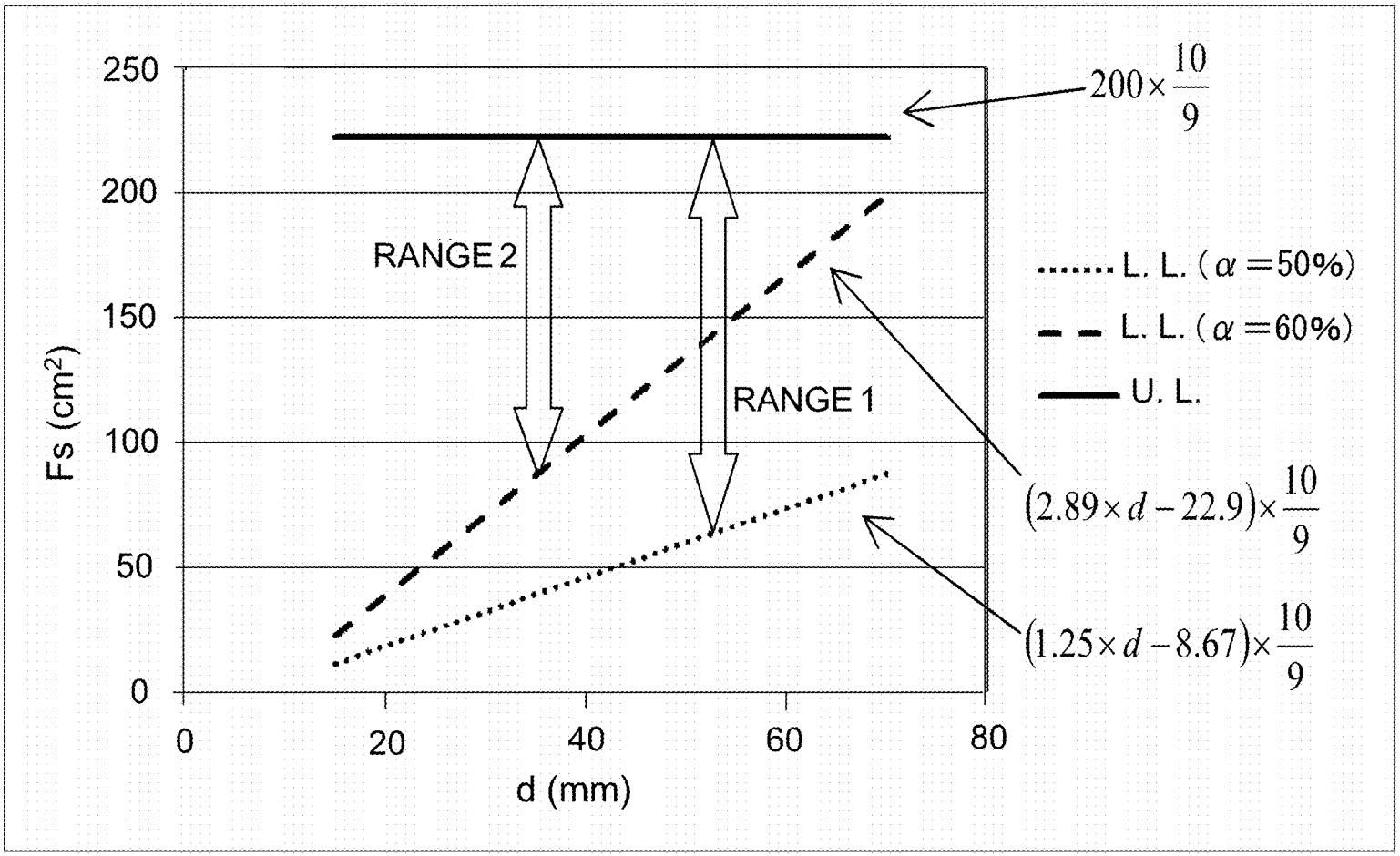

FIG. 19 is a graph showing the relationship between the distance d (mm) between the belt surface and the filter and the filter area Fs (cm^2).

Figure 20:
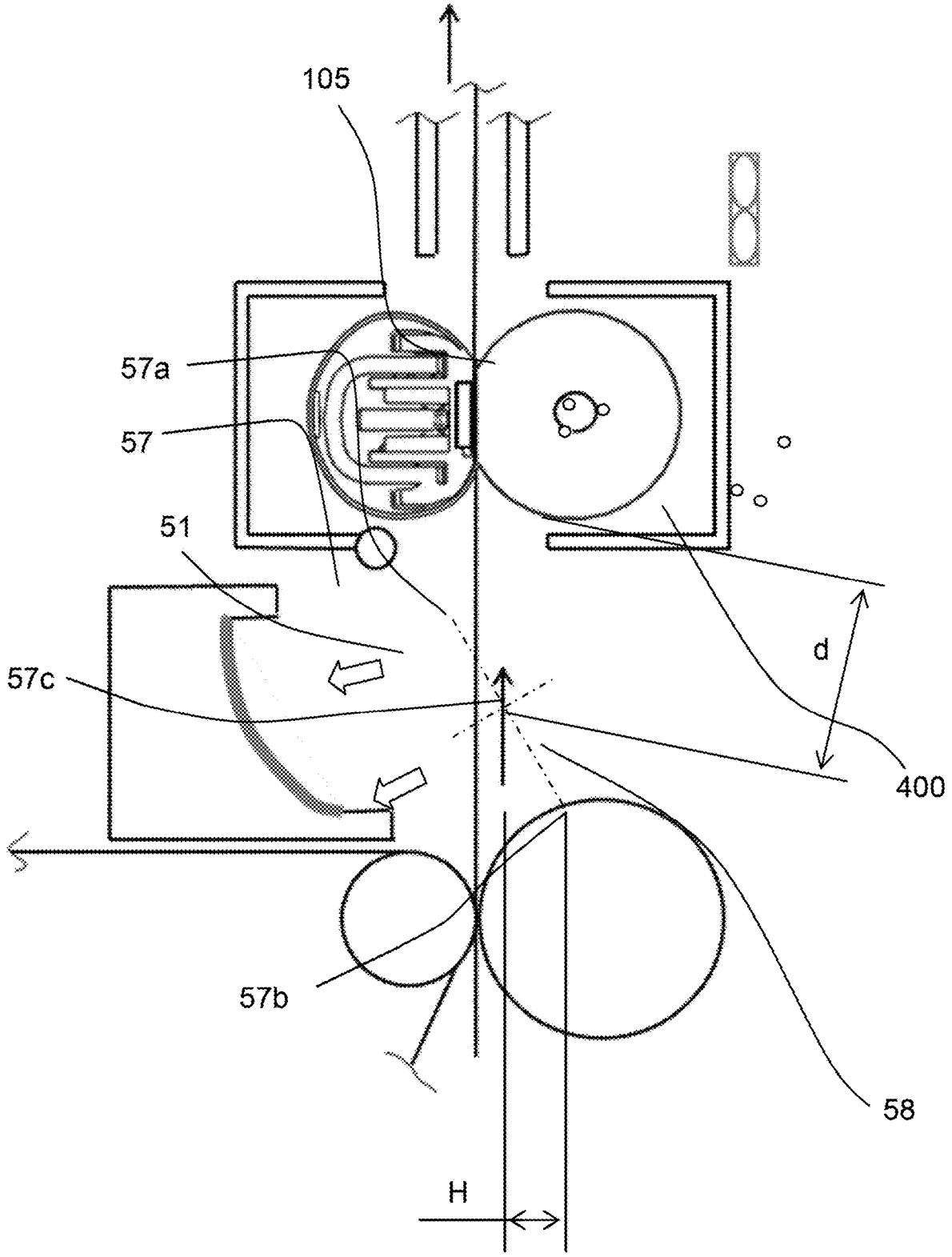

FIG. 20 is an illustration of an example in which the filter is disposed inside the duct.

Figure 21:
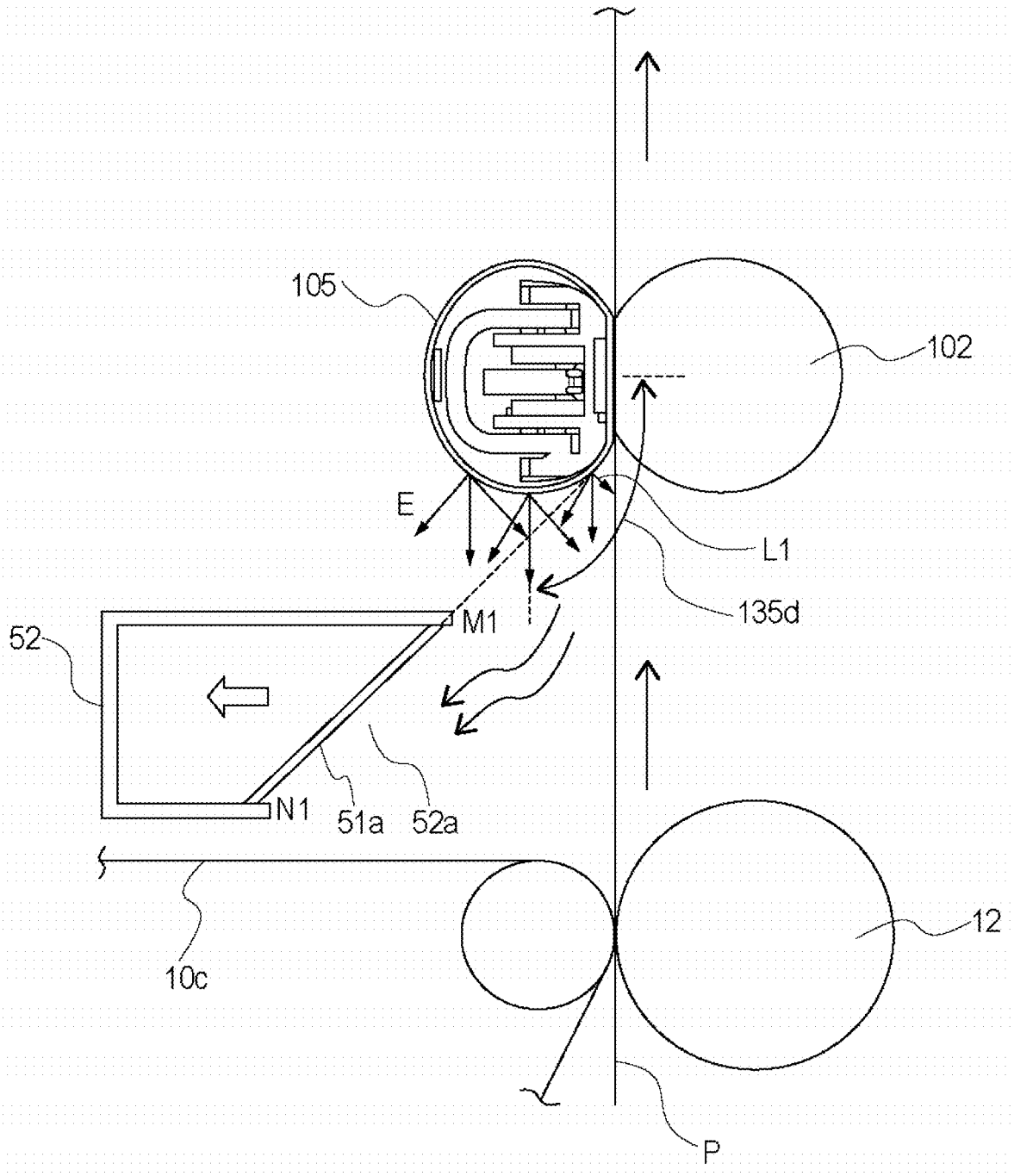

FIG. 21 is a diagram showing a relationship between disposition of filter unit and radiation heat.

Figure 22:
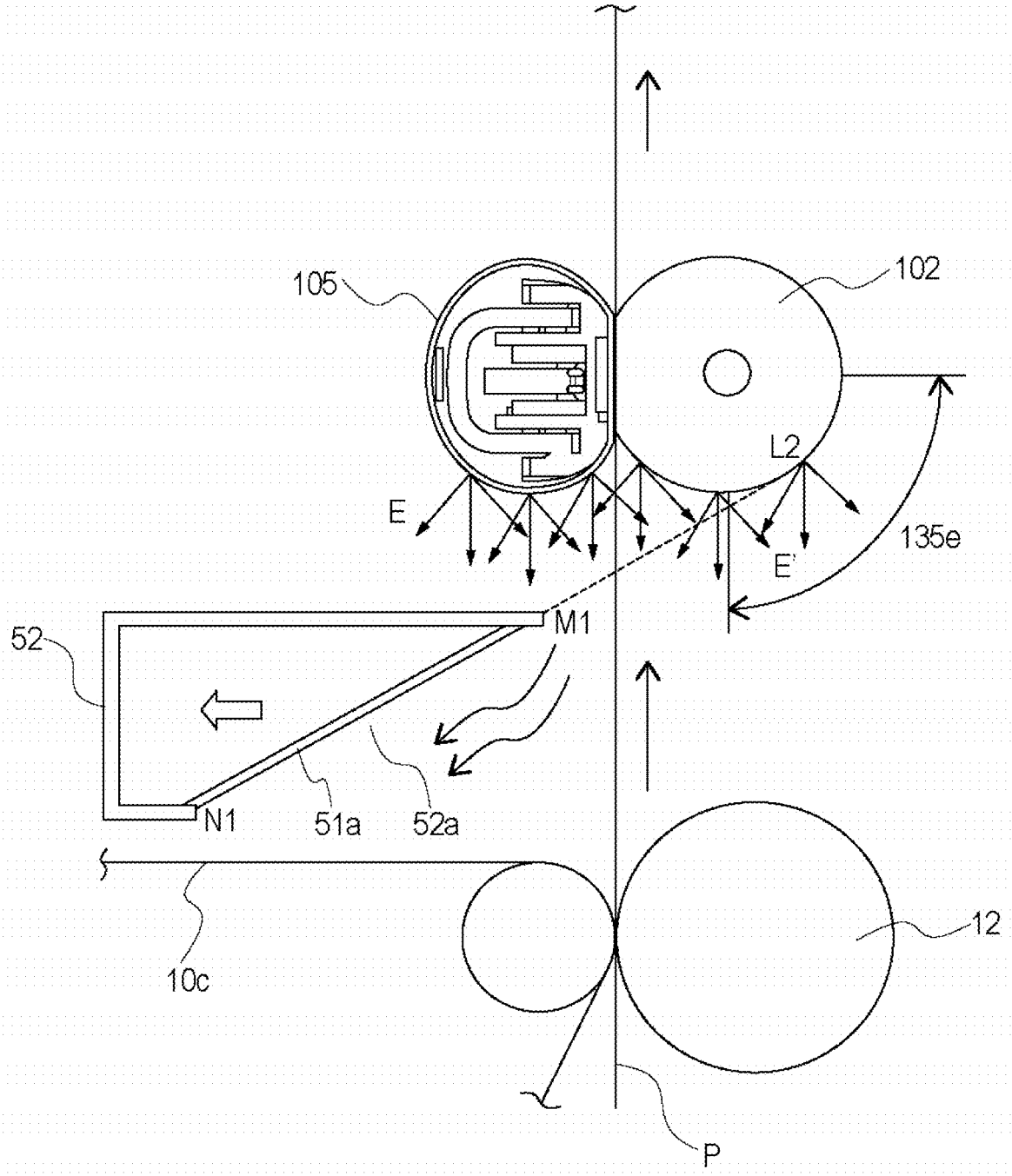

FIG. 22 is a diagram showing the relationship between disposition of the filter unit and radiant heat.

Figure 23:
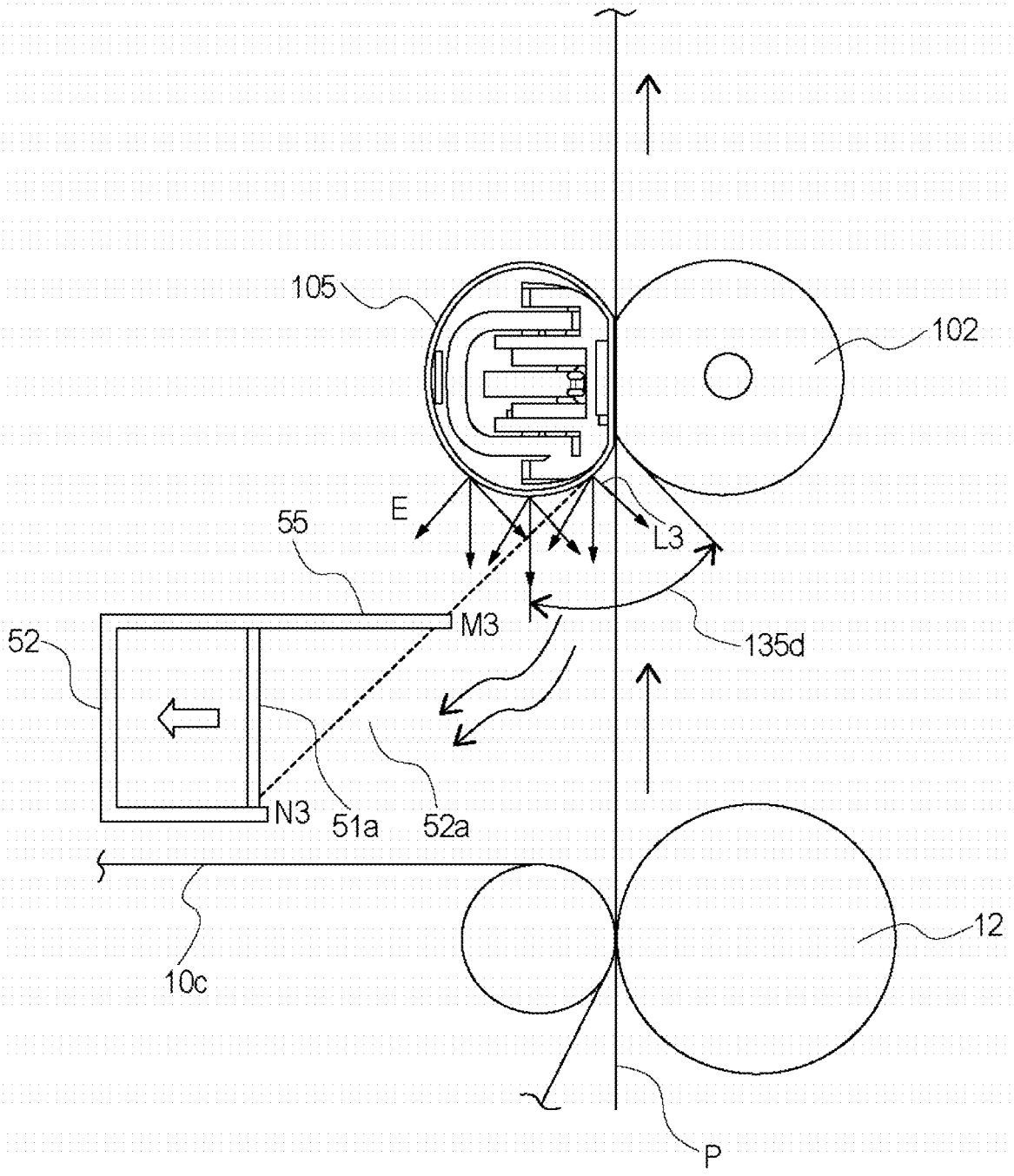

FIG. 23 is a diagram showing the relationship between the disposition of filter unit and radiant heat.

Figure 24:
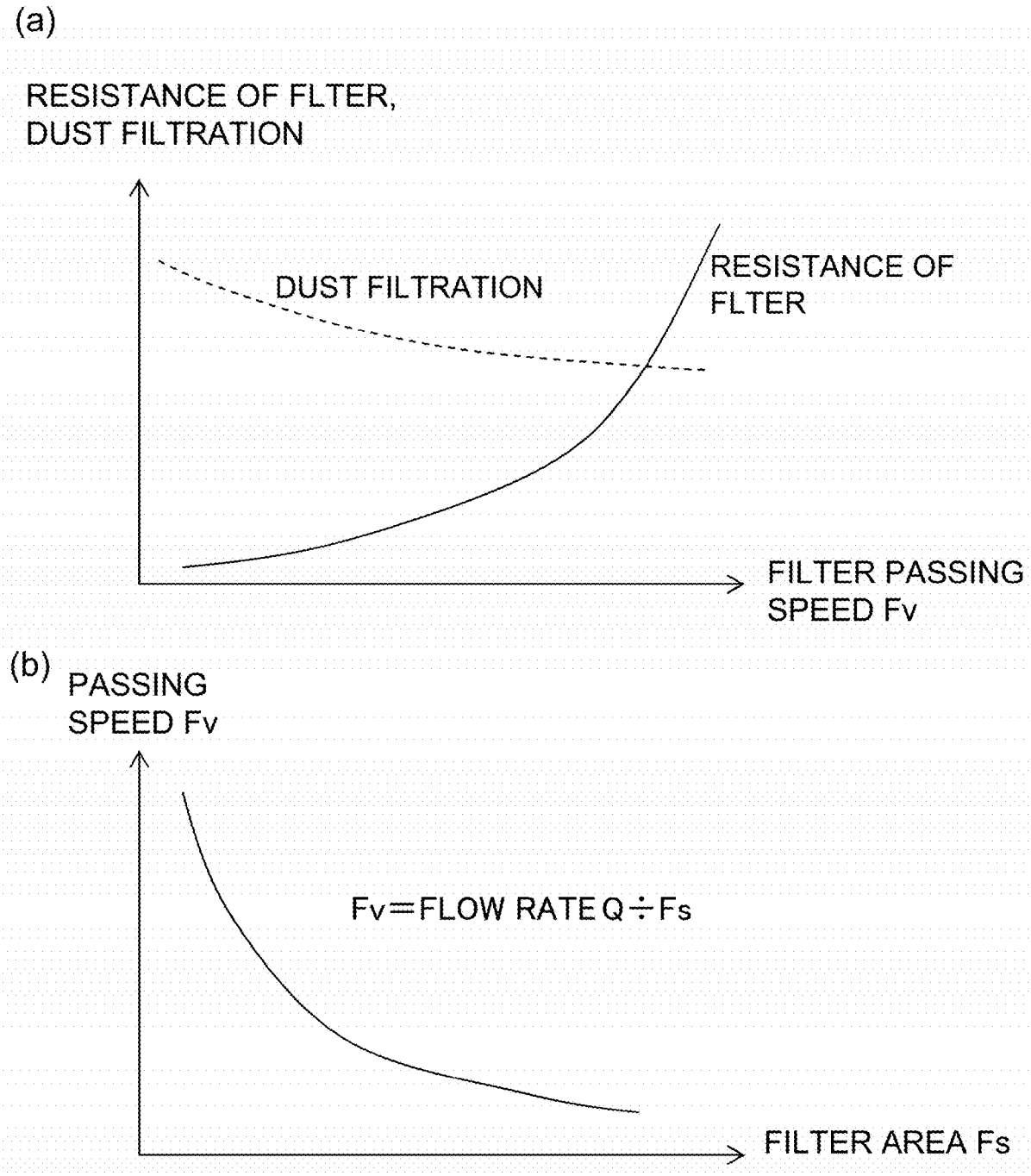

Part (a) of FIG. 24 is a diagram showing the relationship between the filter passing wind speed, the dust filtration ratio of the filter, and the filter passing resistance, and part (b) of FIG. 24 is a diagram showing the relationship between the filter passing wind speed and the filter area.

DETAILED DESCRIPTION OF THE INVENTION

Hereinafter, the present invention will be described in detail using embodiments. Unless otherwise specified, various structures described in the embodiments may be replaced with other known structures within the scope of the concept of the present invention.

Embodiment 1

(1) Overall Structure of Image Forming Apparatus

Figure 4:
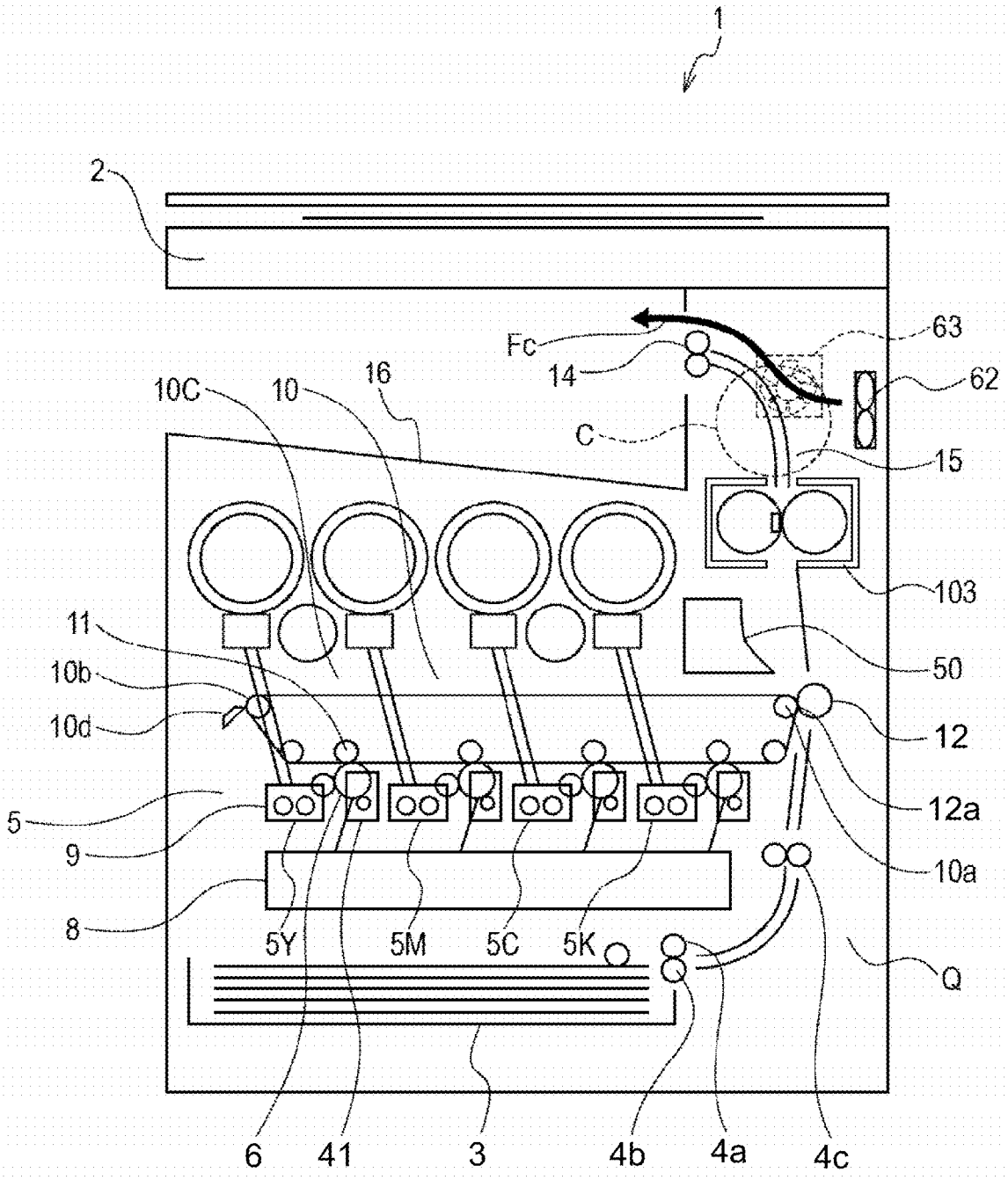
FIG. 4 is a view showing the structure of the image forming apparatus.

Before describing characteristic parts of this embodiment, the overall structure of an image forming apparatus will be described. FIG. 4 is a diagram showing a structure of the image forming apparatus. FIG. 12 is a block diagram showing a relationship between a control circuit and each component. The printer 1 forms an image on the image forming portion using the electrophotographic process, transfers the image to a sheet at the transfer portion, heats the sheet on which the image is transferred, at the fixing unit to fix the image on the sheet P. The printer 1 in the description of this embodiment is a four-color full-color multifunction printer (color image forming apparatus) using an electrophotographic process. The printer 1 may be a monochrome multifunction printer or a single function printer. In the following, the description will be made in detail in conjunction with the Figures.

The printer 1 is provided with a control circuit A for controlling each component in the apparatus. The control circuit A is an electric circuit including a computing unit such as a CPU and a storage unit such as a ROM. The control circuit A functions as a control portion that carries out various controls by the CPU reading a program stored in the ROM or the like. The control circuit A is electrically connected to various structures such as an external information terminal (not shown) of a personal computer or the like, an input device B such as the image reader 2, an operation panel (not shown), or the like. The control circuit A is capable of exchanging signal information with them. The control circuit A collectively controls various components in the device based on the image signal input from the input device B to form an image on the sheet P.

The sheet P is a recording material (paper) on which an image is formed. Examples of sheet P include plain paper, thick paper, OHP sheet, coated paper, label paper and the like.

As shown in FIG. 4, the printer 1 includes first to fourth image forming stations 5Y, 5M, 5C, and 5K (hereinafter referred to as stations) as the image forming portion 5 for forming a toner image. The stations 5Y, 5M, 5C and 5K are disposed side by side from the left side to the right side as shown in FIG. 4.

Each of the stations 5Y, 5M, 5C, and 5K is constituted in substantially the same manner except that the colors of the toners used are different. Therefore, when explaining the detailed structure of the stations 5Y, 5M, 5C, 5K, explanation will be made taking the station 5K as an example. The station 5K has a rotatable drum type electrophotographic photosensitive member (hereinafter referred to as a drum) 6 as an image bearing member on which an image is formed. The station 5K has a cleaning member 41 as a process means acting on the drum 6, a developing unit 9, and a charging roller (not shown).

The first station 5Y accommodates a developer of yellow (Y) color (hereinafter referred to as toner) in the toner accommodating chamber of the developing unit 9. The second station 5M accommodates the toner of magenta (M) color in the toner accommodating chamber of the developing unit 9. The third station 5C accommodates the toner of cyan (C) color in the toner accommodating chamber of the developing unit 9. The fourth station 5K accommodates black (K) toner in the toner accommodating chamber of the developing unit 9.

A laser scanner unit 8 as image information exposure means for the drum 6 is disposed below the image forming portion 5. An intermediary transfer belt unit 10 (hereinafter referred to as transfer portion) is provided above the image forming portion 5.

The transfer portion 10 includes an intermediary transfer belt (hereinafter referred to as a belt) 10*c* and a drive roller 10*a* for driving the same. In addition, the first to fourth primary transfer rollers 11 are disposed in parallel inside the belt 10*c*. Each primary transfer roller 11 is disposed to face the drum 6 of the associated station.

The upper surface portion of each drum 6 of the image forming portion is in contact with the lower surface of the belt 10*c* at the position of the associated primary transfer roller 11. This contact portion is called primary transfer portion.

The driving roller 10*a* is a roller which rotationally drives the belt 10*c*. A secondary transfer roller 12 is disposed outside a portion of the belt 10*c* backed up by a driving roller 10*a*. The belt 10*c* is in contact with the secondary transfer roller 12 which is the transfer means, and the contact portion there between is referred to as a secondary transfer portion 12*a*. A transfer belt cleaning device 10*d* is disposed outside a portion of the belt 10*c* backed up by the tension roller 10*b*. Below the laser scanner unit 8, a cassette 3 for storing sheets P is provided. The sheet P stored in the cassette P absorbs moisture depending on the state of the outside air. A sheet with more moisture absorption generates more steam when it is heated.

As shown in FIG. 4, the printer 1 is provided with a sheet feed path (vertical path) Q for transporting upward the sheet P picked up from the cassette 3. In this sheet feeding path Q, a pair of rollers including a feed roller 4*a* and a retard roller 4*b*, a registration roller pair 4*c*, a secondary transfer roller 12, a fixing device 103, a discharge roller pair 14 are provided. The lower part of the image reader 2 is provided with a discharge tray 16.

(1-1) Image Forming Sequence of Image Forming Apparatus

When the printer 1 performs an image forming operation, the control circuit A performs the following control. The control circuit A rotates the drums 6 of the "first to fourth stations 5Y, 5M, 5C, and 5K" in the clockwise direction at a predetermined speed in accordance with the image formation timing. The control circuit A controls the drive of the drive roller 10*a* so that the belt 10*c* rotates at the speed corresponding to the rotation speed of the drum 6 codirectionally with the rotation of the drum 6. The control circuit A also operates the laser scanner unit 8 and the charging roller (not shown).

By performing the above-described control, the printer 1 forms a full-color image in the following manner.

First, the charging roller (not shown) uniformly charges the surface of the drum 6 to predetermined polarity and potential. Next, the laser scanner unit 8 scans and exposes the surface of the drum 6 with a laser beam modulated in accordance with image information signals of Y, M, C, and K, respectively. In this manner, on the surface of each drum 6, an electrostatic latent image corresponding to the associated color is formed. The formed electrostatic latent image is developed into a toner image by the developing unit 9. The Y, M, C, and K toner images formed in the above-described manner are sequentially superimposed and primarily transferred onto the belt 10*c* in the primary transfer portion and synthesized. In this manner, a full-color unfixed toner image in which toner images of four colors of Y color+M color+C color+K color are synthesized is formed on the belt 10*c*. Then, this unfixed toner image is fed to the transfer portion 12*a* by the rotation of the belt 10*c*. The surface of the drum 6 after the primary transfer of the toner image to the belt 10*c* is cleaned by the cleaning member 41.

On the other hand, one of the sheets P in the cassette 3 is fed by cooperation of the feeding roller 4*a* and the retard roller 4*b*, and is fed to the registration roller pair 4*c*. The register roller pair 4*c* feeds the sheet P to the secondary transfer portion in synchronism with the toner image on the belt 10*c*. A secondary transfer bias voltage having a polarity opposite to the normal charge polarity of the toner is applied to the secondary transfer roller 12. Therefore, when the sheet P is nipped and fed by the secondary transfer portion, the four-color toner image on the belt 10*c* is secondary-transferred all together onto the sheet P.

When the sheet P fed from the secondary transfer portion is separated from the belt 10*c* and fed to the fixing device 103, the toner image is thermally fixed on the sheet P. The sheet P fed from the fixing device 103 is discharged to the discharge tray 16 via the guide member 15 by the discharge roller pair 14. The residual toner remaining on the surface of the belt 10*c* after the toner image is secondarily transferred onto the sheet P is removed from the surface of the belt by the transfer belt cleaning device 10*d*.

(2) Fixing Device

Next, the fixing device 103 and the dust D produced in the neighborhood of the fixing device 103 will be described.

(2-1) Fixing Apparatus 103

Figure 5:
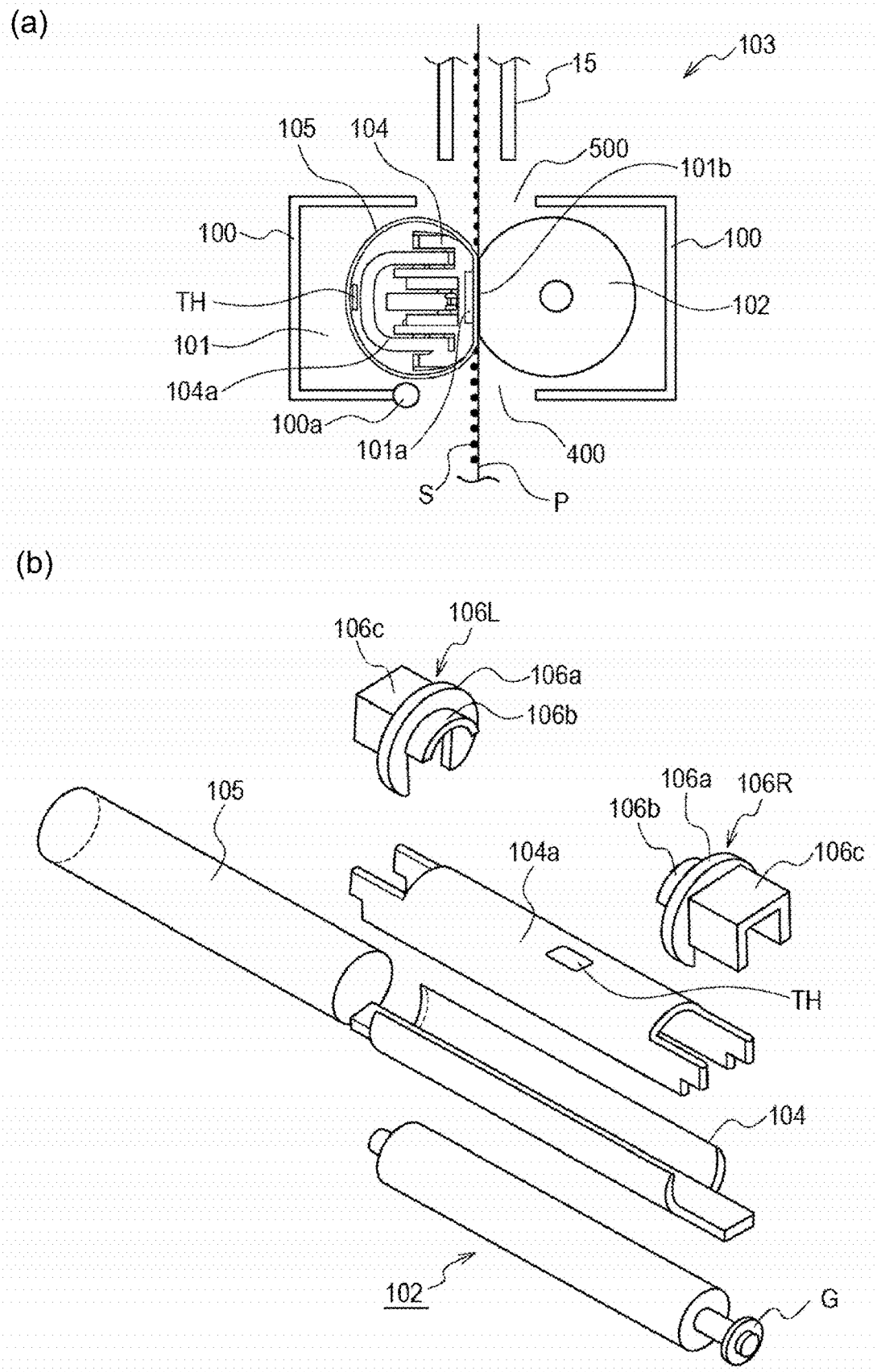
In FIG. 5, part (a) shows a cross section of the fixing unit, and part (b) shows a state in which the belt unit is disassembled.

Part (a) of FIG. 5 is a sectional view of the fixing unit. Part (b) of FIG. 5 is an exploded view of the belt unit. The fixing device 103 in this embodiment is a low heat capacity fixing device for fixing a toner image on the sheet P by using the small diameter fixing belt 105 (hereinafter referred to as a belt) heated by the heater 101*a*. The fixing device 103 includes a fixing belt unit 101 (referred to as a fixing unit) including a belt 105 as a rotatable member, a pressure roller 102 as a rotatable member, a planar heater 101*a* as a heating portion, and a casing 100. As shown in part (a) of FIG. 5, the casing 100 is provided with a sheet entrance 400 and a sheet exit 500. The sheet P passes through the nip portion 101*b* between the fixing unit 101 and the pressure roller 102. In this embodiment, the sheet entrance 400 is disposed below the sheet exit 500. Therefore, the sheet P is fed upward. This structure is referred to as the vertical path structure.

At the sheet entrance 400, a plurality of rollers 100*a* formed of thin plate-like rotating disks are juxtaposed in the rotation axis direction of the belt 105. The rollers 100*a* guide the sheet P deviated from the feeding path, so that adhesion of toner to the casing 100 is suppressed.

On the downstream side of the sheet exit 500 in the feeding direction of the sheet P, a guide member 15 (a guide member) for guiding the conveyance of the sheet through the nip portion 101*b* is provided. In the following description, the downstream side in the feeding direction of the sheet P will be referred to as the downstream side, and the upstream side in the feeding direction of the sheet P will be referred to as the upstream side.

(2-2) Configuration of Fixing Unit 101

The fixing unit 101 makes contact with a pressure roller 102 to be described later, forms a nip portion 101*b* between itself and the pressure roller 102, and fixes the toner image on the sheet P in the nip portion 101*b*. The fixing unit 101 is an assembly comprising a plurality of members, as shown in parts (a) and (b) of FIG. 5.

The fixing unit 101 includes a planar heater 101*a*, a heater holder 104 which holds the heater 101*a*, and a pressure stay 104*a* which supports the heater holder 104. The fixing unit 101 further includes an endless belt 105 and flanges 106L and 106R which hold one end side and the other end side with respect to the width direction of the belt 105.

The heater 101*a* is a heating member contacting the inner surface of the belt 105 to heat the belt 105. In this embodiment, as the heater 101*a*, a ceramic heater which generates heat by electric energization is used. The ceramic heater is a low heat capacity heater including a long and thin plate-shaped ceramic substrate and a resistive layer provided on the substrate surface, and the whole of the heater quickly generates heat when the resistive layer is energized.

The heater holder 104 is a holding member holding the heater 101*a*. The holder 104 of this embodiment has a semicircular arcuate cross portion and regulates the circumferential shape of the belt 105. The material of the holder 104 is preferably heat resistant resin.

The pressure stay 104*a* uniformly presses the heater 101*a* and the holder 104 against the belt 105 in the longitudinal direction. The pressure stay 104*a* is desirably made of a material which is not easily bent even when subjected to a high applied pressure. In this embodiment, stainless steel SUS 304 is used as the material of the pressure stay 104*a*. A thermistor TH as a temperature sensor is provided on the pressure stay 104*a*. The thermistor TH outputs a signal corresponding to the temperature of the belt 105 to the control circuit A.

The belt 105 is a rotatable member contacting the sheet P and applying heat to the sheet P. The belt 105 is a cylindrical (endless) belt and has a flexibility as a whole. The belt 105 covers the heater 101*a*, the heater holder 104, and the pressure stay 104*a* at the outside.

Figure 2:
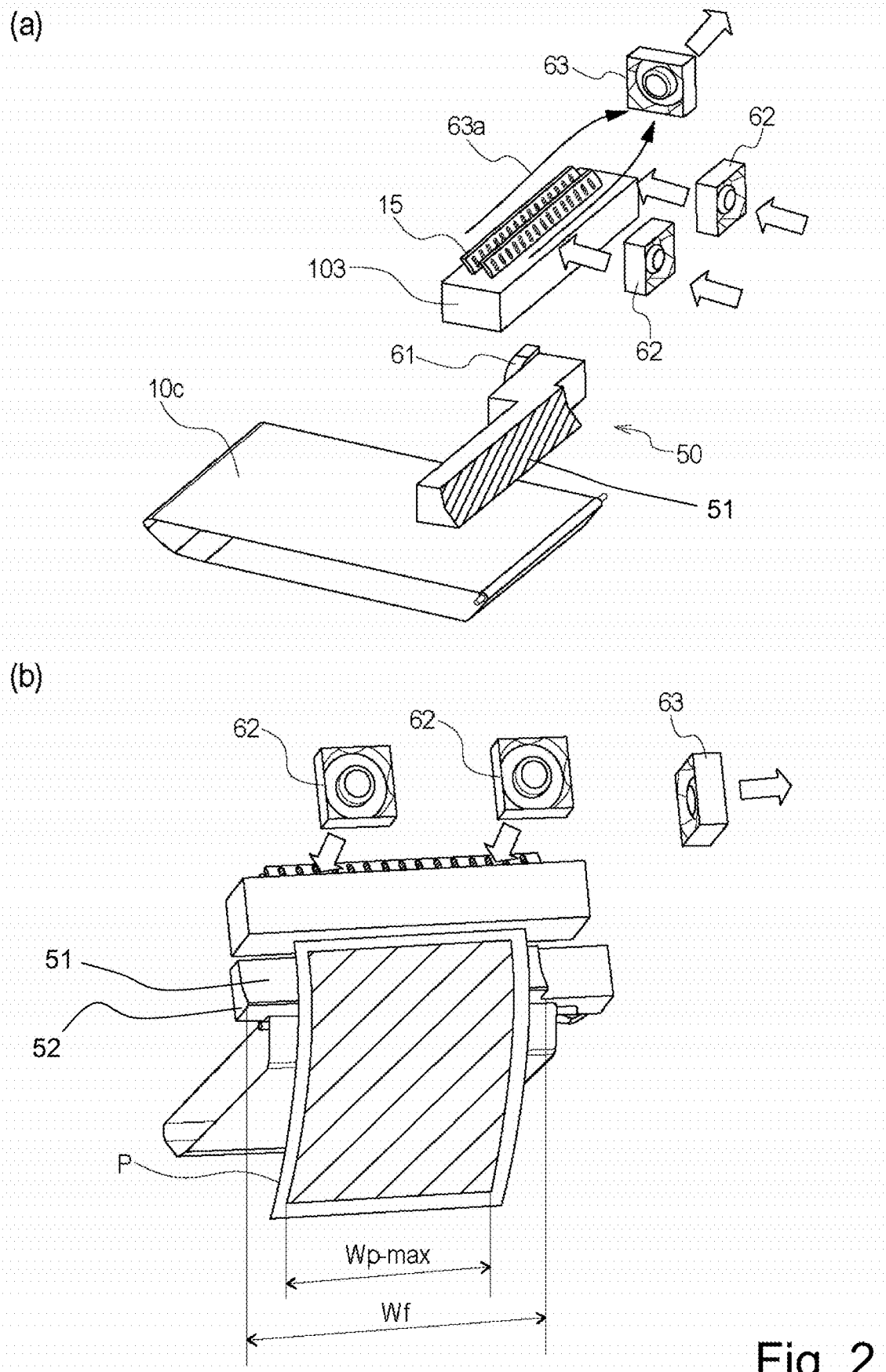
In FIG. 2, part (a) is a perspective view of the periphery of the fixing device, and part (b) is a view illustrating a position where a sheet passes in the neighborhood of the fixing device.

The flanges 106L and 106R are a pair of members for rotatably holding the end portion of the belt 105 in the longitudinal direction. As shown in FIG. 2, the flanges 106L and 106R have a flange portion 106*a*, a backup portion 106*b*, and a pressed portion 106*c*, respectively. The flange portion 106*a* is abutted by the end surface of the belt 105 to restrict the movement of the belt 105 in the thrust direction, and has a larger outer diameter than the diameter of the belt 105. The backup portion 106*b* is a portion for holding the cylindrical shape of the belt 105 by holding the inner surface of the fixing belt. The pressed portion 106*c* is provided on the outer surface side of the flange portion 106*a* to receive a pressing force by pressure springs 108L and 108R (see FIG. 7) which will be described hereinafter.

Part (a) of FIG. 6 shows a sheet fed to the neighborhood of the nip portion of the fixing unit. Part (b) of FIG. 6 shows the layer structure of the belt. FIG. 6 (*c*) shows the layer structure of the pressure roller 102.

The belt 105 of this embodiment comprises a plurality of layers. In detail, the belt 105 includes endless (cylindrical) base layer 105*a*, primer layer 105*b*, elastic layer 105*c*, and parting layer 105*d* in the order named from the inside to the outside.

The base layer 105*a* is a layer for assuring the strength of the belt 105. The base layer 105*a* is a metal base layer of such as SUS (stainless steel) and has a thickness of about 30 μm so as to withstand thermal stress and mechanical stress.

The primer layer 105*b* bonds the base layer 105*a* and the elastic layer 105*c* to each other. The primer layer is provided on the base layer 105*a* by applying a primer with a thickness of about 5 μm.

The elastic layer 105*c* is deformed when the toner image is brought into pressure contact with the nip portion 101*b* to bring the parting layer 105*d* into close contact with the toner image. The material of the elastic layer 105*c* may be a heat-resistant rubber.

The parting layer 105*d* prevents toner and paper dust from adhering to the belt 105. As the parting layer 105*d*, a fluororesin such as a PFA resin exhibiting excellent releasability and heat resistance can be used. The thickness of the parting layer 105*d* of this embodiment is 20 μm in consideration of heat conductivity.

(2-3) Structure of Pressure Roller and Pressing Method

Part (c) of FIG. 6 shows a layer structure of the pressure roller 102. The pressure roller 102 is a nip forming member which forms a nip between the pressing roller 102 and the belt 105 by contacting with the outer peripheral surface of the belt 105. The pressure roller 102 of this embodiment is a roller member including a plurality of layers. In detail, the pressure roller 102 has a core metal 102*a* of metal (aluminum or iron), an elastic layer 102*b* formed of silicone rubber or the like, and a parting layer 102*c* covering the elastic layer 102bing. The parting layer 102*c* is a tube made of a fluororesin such as PFA and is adhered on the elastic layer 102*b*.

As shown in FIG. 7, one end side of the core metal 102*a* is rotatably supported by the side plate 107L by way of a bearing 113. The other end side of the core metal 102*a* is rotatably supported by the side plate 107R by way of a bearing 113. At this time, the part of the pressure roller 102 including the elastic layer 102*b* and the parting layer 102*c* is located between the side plate 107L and the side plate 107R.

The other end side of the core metal 102*a* is connected to a gear G. When the gear G is driven by a drive motor (not shown), the pressure roller 102 rotates.

The fixing unit 101 is supported by the side plate 107L and the side plate 107R so that the fixing unit 101 can slide and move in the direction toward and away from the pressure roller 102. In detail, the flanges 106L and 106 R are fitted into the guide grooves of side plate 107L and side plate 107R, respectively. The pressed portions 106*c* of the flanges 106L and 106R are pressed against the pressure roller 102 with a predetermined pressing force T by the pressure springs 108L and 108R supported by the spring support portions 109R and 109L.

By the pressing force T, the flanges 106L and 106R, the pressure stay 104*a*, and the heater holder 104 are entirely biased toward the pressure roller 102. Here, the side of the fixing unit 101 including the heater 101*a* faces the pressure roller 102. Therefore, the heater 101*a* presses the belt 105 toward the pressure roller 102. With such a structure, the belt 105 and the pressure roller 102 are deformed so that the nip portion 101*b* (see FIG. 6) is formed between the belt 105 and the pressure roller 102.

As described above, when the pressure roller 102 rotates in a state that the fixing unit 101 and the pressure roller 102 are in close contact with each other, a rotational torque acts on the belt 105 due to the frictional force between the belt 105 and the pressure roller 102 in the nip portion 101*b*. The belt 105 is rotated by the pressure roller 102 (R105). The rotation speed of the belt 105 at this time almost corresponds to the rotation speed of the pressure roller 102. In other words, in this embodiment, the pressure roller 102 has a function as a drive roller which rotationally drives the belt 105.

At this time, the inner peripheral surface of the belt 105 and the heater 101*a* slide relative to each other. Therefore, it is desirable to apply grease to the inner surface of the belt 105 to reduce the sliding resistance.

(2-4) Fixing Process

Using the above-described structure, the fixing device 103 carries out a fixing process during the image forming process. During the fixing process, the control circuit A controls the drive motor (not shown) to rotationally drive the pressure roller 102 in the rotational direction R102 (part (a) of FIG. 1) at a predetermined speed to drive the belt 105.

Further, the control circuit A starts energizing the heater 101*a* through an electric power supply circuit (not shown). The heater 101*a* which generates heat by this energization imparts heat to the sliding belt 105. The temperature of the belt 105 to which the heat is applied gradually rises. The control circuit A controls the power supplied to the heater 101*a* on the basis of the signal outputted from the thermistor TH so that the temperature of the belt 105 is maintained at the target temperature TP. The target temperature TP (part (a) in FIG. 14) of this embodiment is about 170° C.

When the belt 105 is heated to the target temperature TP, the control circuit A controls each structure to feed the sheet P carrying the toner image S to the fixing device 103. The sheet P fed to the fixing device 103 is nipped and fed by the nip portion 101*b*.

In the process in which the sheet P is nipped and fed in the nip portion 101*b*, the heat of the heater 101*a* is applied to the sheet P through the belt 105. The unfixed toner image S is melted by the heat of the heater 101*a* and is fixed to the sheet P by the pressure applied to the nip portion 101*b*. The sheet P having passed through the nip portion 101*b* is guided to the discharge roller pair 14 by the guide member 15 and is discharged onto the discharge tray 16 by the discharge roller pair 14. In this embodiment, the process described above is called fixing process.

(3) Protection of Dust D

Next, the description will be made as to the production of ultrafine particles (hereinafter referred to as dust D) caused by a parting material (hereinafter referred to as wax) contained in toner S and as to properties of dust D.

(3-1) Wax Contained in Toner S

As described above, the fixing device 103 fixes the toner image on the sheet by the contact between the high-temperature belt 105 and the sheet P. When performing the fixing process using such a structure, some toner S may transfer (adhere) to the belt during the fixing process. This is called offset phenomenon. It is desirable to exclude this offset phenomenon—because it causes image failure.

Therefore, in this embodiment, wax (releasing agent) is included in the toner S used for forming the toner image. When this toner S is heated, the internal wax dissolves and seeps out. Therefore, when the fixing process is applied to the image formed by the toner S, the surface of the belt 105 is covered with the melted wax. The toner S is less likely to adhere to the belt 105 with the surface thereof covered with wax, because of the releasing property of the wax.

In this embodiment, in addition to pure wax, a compound containing the molecular structure of wax is called wax. For example, a compound in which a resin molecule of a toner and a wax molecular structure such as a hydrocarbon chain are reacted is also called a wax. As a parting material, in addition to wax, a substance having a releasing property such as silicone oil may be used.

As the wax, it is possible to use a wax material which instantly dissolves in the nip portion 101*b* and seeps out of the toner S when the belt 105 is maintained at the target temperature Tp. In this embodiment, paraffin wax having a melting point Tm of 75° C. was used, while the target temperature Tp was 170° C.

When the wax melts, some of the waxes vaporize (volatilize). It is thought that this is because the size of the molecular components contained in the wax varies. In other words, the wax contains a low-molecular-weight component including a short chain and a low boiling point, and a polymer component including a long chain and a high boiling point, and it is considered that a low-molecular component including a low boiling point will vaporize first.

When the vaporized (gasified) wax component is cooled in the air, fine particles (dust D) of about several nm to several hundred nm are produced. However, it is estimated that most of the produced microparticles have a particle size of several nm to several tens nm.

This dust D is a sticky wax component and easily adheres to various parts in the internal structure of the printer 1. For example, when the dust D is carried to the periphery of the guide member 15 or the discharge roller pair 14 by the upward air flow caused by the heat of the fixing device 103, the wax adheres, deposits and adheres to the guide member 15 and to the discharge roller pair 14. If the guide member 15 and the discharge roller pair 14 are contaminated with such wax, then the wax adheres to the sheet P, causing image defects.

(3-2) Particles (Dust) Produced from the Wax due to the Fixing Process

According to the investigations of the inventors of the present application, it has been found that most of the above-described dust D exists in the neighborhood of the sheet entrance (FIG. 1) of the fixing device 103. In addition, it has been found that the dust D become larger in particle diameter and became more likely to adhere to nearby members under high temperature conditions. It will be explained in detail below.

(3-2-1) Nature of Dust

As a property of the dust produced from the wax, the particle size is increased at high temperature, and the large particle size dust D adheres to the surrounding solid parts. Part (a) of FIG. 8 shows a dust coalescence phenomenon. Part (b) of FIG. 8 is a schematic diagram showing the dust adhesion phenomenon.

As shown in part (a) of FIG. 8, when the material 20 having a high boiling point of 150 to 200° C. is placed on a heating source 20*a* and is heated up to about 200° C., the volatile substance 21*a* is evaporated from the high boiling point substance 20. When the volatile substance 21*a* comes into contact with normal temperature air, the temperature thereof immediately reaches the boiling point or lower temperature, and condenses in the air into fine particles 21*b* having a particle diameter of about several nm to several tens nm. This phenomenon—is the same as a phenomenon—that when water vapor falls below the dew point temperature, it becomes fine water droplets and produces fog.

At this time, the agglomeration/particulation of the gas in the air is easily inhibited as the temperature in the air is higher. This is because the gas vapor pressure is higher as the air temperature is higher, and therefore, the gas molecules are more likely to maintain the gas state. Therefore, as the temperature of the air increases, the number of microparticles 21*b* produced decreases.

The gases present in the air tend to gather around and agglomerate around the already produced microparticles 21*b*. This is because the energy required for the gas molecules to agglomerate around the microparticles 21*b* is lower than the energy required for aggregation of the gas molecules to newly generate the microparticles 21*b*.

In addition, since the microparticles 21*b* are moving in the air by the Brownian motion, it is known that they collide with each other and coalesce to grow into particles 21*c* having a larger particle size. This growth is promoted as the microparticles 21*b* move actively, in other words, the more the air is in a high temperature state (Brownian motion becomes stronger), the more it is promoted. By this, the particle size of the fine particles produced from the belt 105 becomes larger and the number decreases as the space temperature in the neighborhood of the belt 105 becomes higher. The size of the fine particles gradually decreases, and stops when the particle size exceeds a certain size. It is predicted that this is because Brownian motion becomes inactive when the particle is enlarged by coalescence, and the frequency of collisions between particles decreases.

Referring to part (b) of FIG. 8, the adhesion of fine particles will be described When the air a containing the microparticles 21*b* and the particles 21*c* larger than the microparticles 21*b* are directed to the wall 23 along the air flow 22, the microparticles 21*c* larger than the microparticles 21*b* are more likely to adhere to the wall 23.

This is presumed to be because the inertia force of the fine particles 21*c* is greater and collides with the wall 23 vigorously. Therefore, the dust D tends to adhere to the inside of the fixing device (mostly the belt 105) as the increase of the particle size of the dust D is promoted while maintaining the atmosphere near the belt 105 at a high temperature. Therefore, as the increase of the particle size of the dust D is promoted, the dust D becomes difficult to diffuse outside the fixing device as a result.

As described above, the dust D has two properties, namely, the property of promoting coalescence under high temperature to increase the particle size and the property of being easy to adhere to the surrounding object by increasing the particle size. Easiness of coalescence of dust D depends on the components of dust D, temperature and concentration. For example, the higher the concentration of dust D, the higher the collision probability between dust particles D is, and the lower the viscosity of dust D, the easier the dust D coalesces.

(3-2-2) Place Where Dust D Produces

Next, referring to FIGS. 10 and 11, the location of production of dust D will be described. Part (a) of FIG. 10 shows the state of the wax adhesion area on the fixing belt which area expands with the progress of the fixing process. Part (b) of FIG. 10 shows the relationship between the adhesion area of wax and the production area of dust D. FIG. 11 illustrates the flow of the air flow around the fixing belt.

By the verification of the inventors, it was found that the amount of dust D produced from the fixing device 103 is larger at the upstream side of the nip portion 101*b* than at the downstream side of the nip portion 101*b*. The mechanism will be explained below.

The surface (the parting layer 105*d*) of the belt 105 immediately after passing through the nip portion 101*b* is deprived of heat by the sheet P, and therefore, the temperature thereof is lower to about 100° C. Meanwhile, the temperature of the inner surface and the back surface (base layer 105*a*) of the belt 105 is kept high by the contact with the heater 101*a*. Therefore, after the belt 105 passes through the nip portion 101*b*, the heat of the base layer 105*a* maintained at a high temperature is transmitted to the parting layer 105*d* through the primer layer 105*b* and the elastic layer 105*c*. For this reason, the temperature of the surface (parting layer 105*d*) of the belt 105 rises after passing through the nip portion 101*b* in the process of rotating in the R105 direction (FIG. 10), and in the neighborhood of the entrance side of the nip portion 101*b*, the maximum temperature is reached.

On the other hand, the wax seeped out of the toner S on the sheet P is present at the interface between the belt 105 and the toner image when the fixing process is performed. After that, a part of the wax adheres to the belt 105. As shown in part (a) of FIG. 10, at the stage when a part of the leading end side of the sheet P passes through the nip portion 101*b*, the wax transferred from the toner S to the belt 105 exists in the region 135*a*. In this area, the temperature of the belt 105 is low and it is difficult for the wax to volatilize. Therefore, dust D is hardly produced. As the sheet P advances through the nip portion 101*b*, the wax is in a state that it is present substantially all around (135*b*) of the belt 105. Since the temperature of the belt is high in the area 135*c*, the wax tends to volatilize. Then, when the wax volatilized from the region 135*c* condenses, the dust D is produced. Therefore, there are many dust particles D in the neighborhood of the area 135*c*, that is, adjacent to the entrance of the nip portion 101*b* (upstream side).

Further, the dust D in the neighborhood of the entrance of the nip portion 101*b* diffuses in a direction of an arrow W by the air flow shown in FIG. 11. The details are as follows. As shown in FIG. 11, when the belt 105 rotates in the arrow R105 direction, an air flow F1 along the direction of R105 is produced adjacent to the surface of the belt 105. When the sheet P is fed along the X direction, the air flow F2 along the feeding direction X of the sheet P is produced. When the air flow F1 collides with the air flow F2 in the neighborhood of the nip portion 101*b*, the air flow F3 is produced along the direction (W direction) away from the nip portion 101*b*.

(3-2-3) Verification

Tests have been conducted to verify the relationship between the amount of produced dust D and the temperature. Part (a) of FIG. 9 is a graph showing the relationship between the elapsed time of image formation processing and the amount of produced dust D in Test 1.

Part (b) of FIG. 9 is a graph for explaining the relationship between the elapsed time of image forming processing and the amount of produced dust D in Test 2.

In the tests, the air in the neighborhood of the sheet entrance 400 is sampled during image forming operation of the printer 1, and the number concentration of particles is measured using a nanoparticle particle size distribution measuring instrument.

Here, in Test 1, nothing is adjusted during the image forming process so that the air in the sheet entrance 400 (in the neighborhood of the nip portion) is warmed up. In Test 2, the outside air is blown in the neighborhood of the sheet entrance 400 during the image forming process so that the air in the sheet entrance 400 (in the neighborhood of the nip portion) is cooled.

As shown in part (a) of FIG. 9, the amount of produced dust D in Test 1 rises immediately after the start of image formation processing, reaches a peak after about 100 seconds, and then gradually decreases. In part (a) of FIG. 9, the amount of produced dust D decreases with time because the temperature around the belt 105 rises with the progress of the image forming process.

As shown in part (b) of FIG. 9, it is understood that the amount of produced dust D in Test 2 rises more abruptly than in Test 1 immediately after the start of the image formation processing, and reaches the peak after about 20 seconds. At this time, the amount of produced dust D from the start of the image forming process to the lapse of 200 seconds in Test 2 is 2 to 5 times that in Test 1.

On the other hand, when the time exceeds 300 seconds after the start of the image forming operation, there is no large difference in the amount of produced dust D between Test 1 and Test 2. This is presumably because peripheral units (not shown) heated by the heat of the fixing device 103 warms the outside air toward the sheet entrance 400 in advance.

As described above, the dust D is easy to produce in the neighborhood of the sheet entrance 400. Therefore, it is desirable for the image forming apparatus to remove the dust D adjacent to the sheet entrance 400.

Also, if the air at the sheet entrance 400 is cold, the dust D is likely to be produced. Therefore, it is preferable that the printer 1 does not cool the air at the sheet entrance 400 and to suppress production of the dust D. As described above, the dust D remarkably produces during a certain period immediately after the start of the image forming process. Therefore, it is desirable for the printer 1 to efficiently collect (filter) the dust D immediately after the start of the image forming process.

(4) Collecting Method of Dust D

Based on the properties of the dust D described above, the method of collecting dust D will be explained. First, the structure and operation of a filter unit 50 for filtering the dust D will be described, then the air flow structure for suppressing outflow of the dust D from the neighborhood of the filter unit 50 will be described. Finally, the description will be made as to the operation sequence of the air flow.

Figure 1:
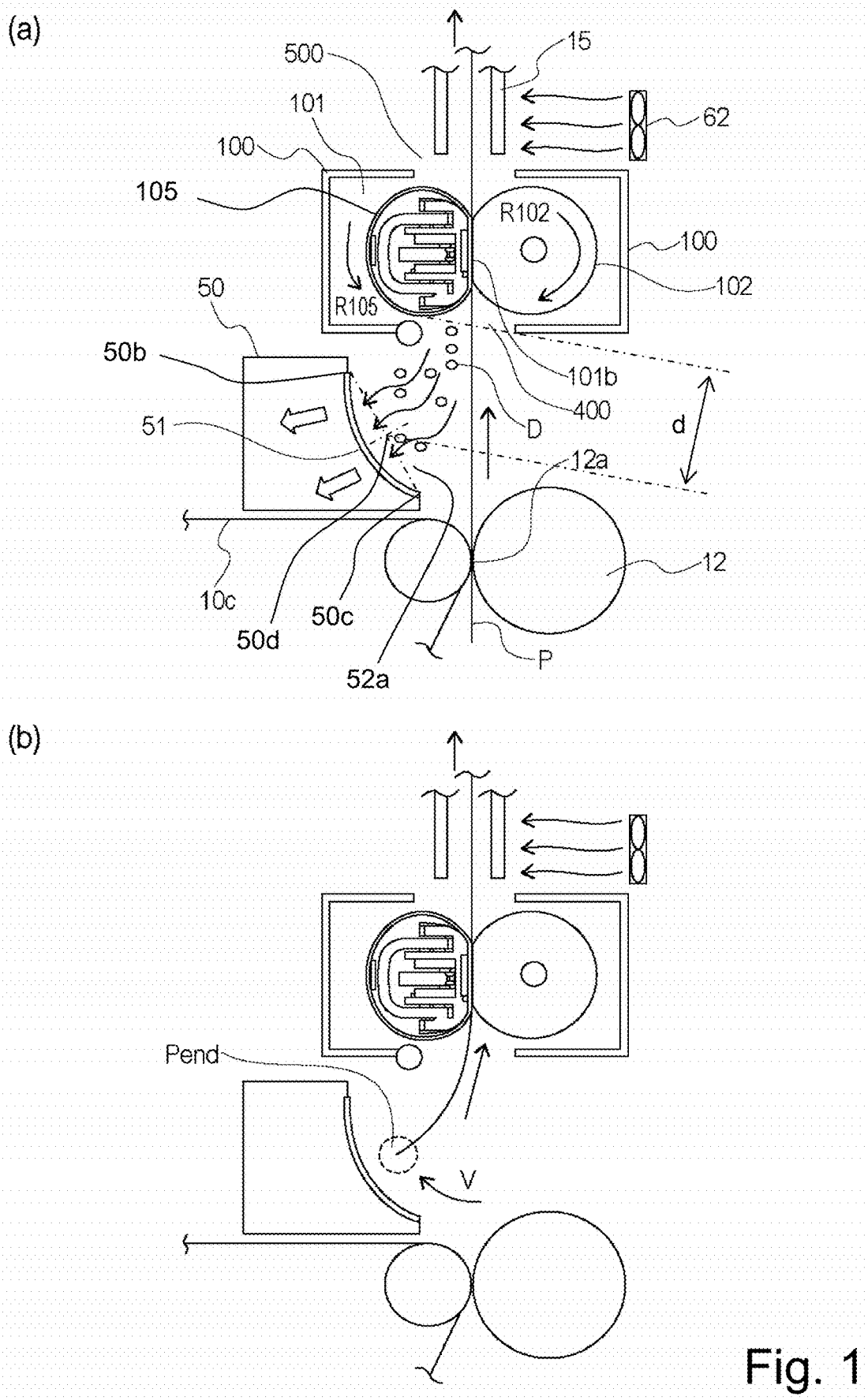
In FIG. 1, part (a) shows a state of collecting dust in the neighborhood of the fixing device, and part (b) shows a state of the trailing end flapping of the sheet.
Figure 3:
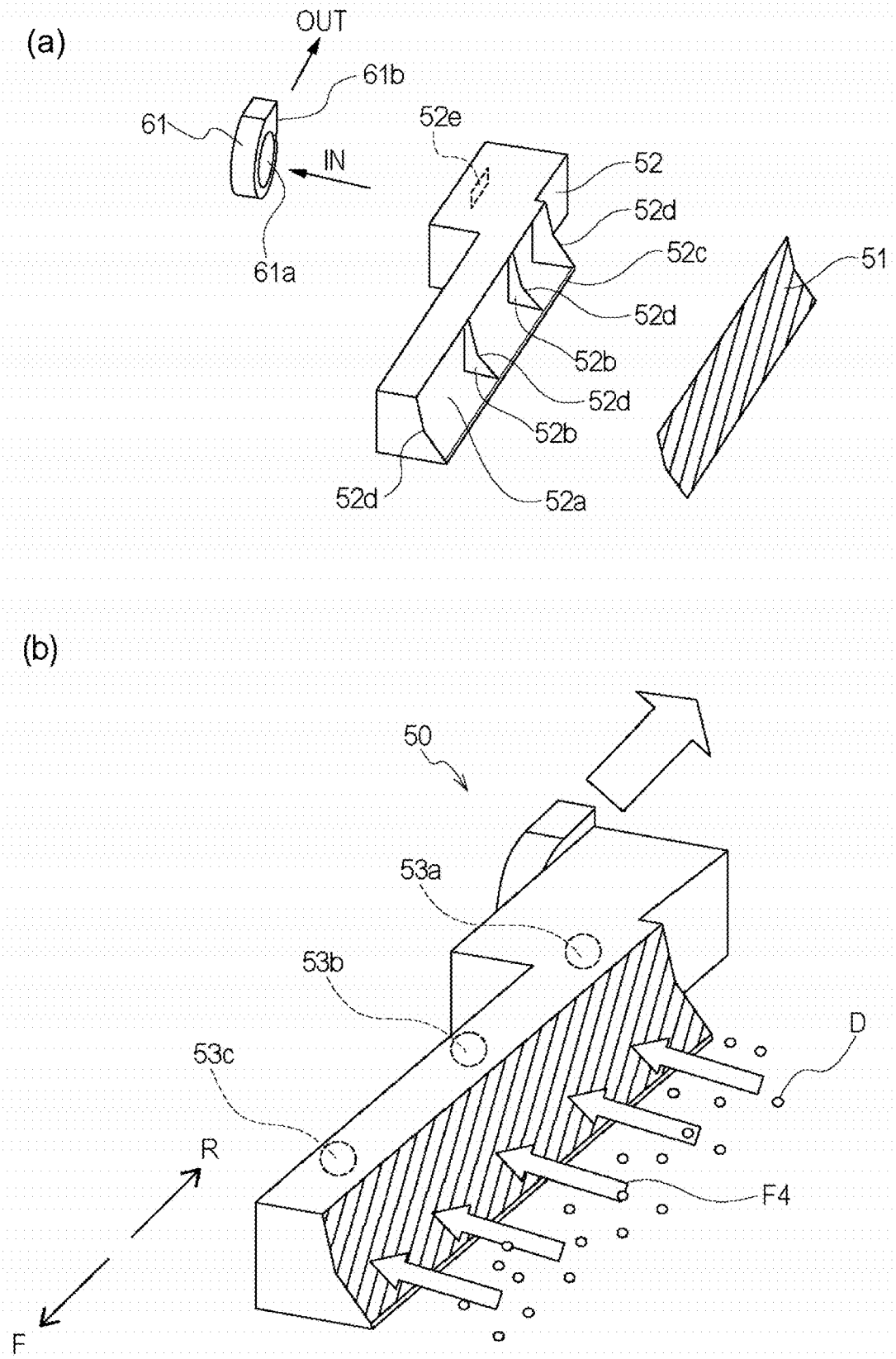
In FIG. 3, part (a) is a perspective view illustrating the duct unit disassembled, and part (b) is a view illustrating how the duct unit operates.

Part (a) of FIG. 1 is an illustration showing the position of filter units. Part (b) of FIG. 1 is an illustration of the state of trailing end flapping of the sheet and the shape of the filter unit. Part (a) of FIG. 2 is a perspective view of a structure around the fixing device provided side by side. Part (b) of FIG. 2 is a view showing the passage position of the sheet in the neighborhood of the fixing device. Part (a) of FIG. 3 is an exploded perspective view of the filter unit. Part (b) of FIG. 3 illustrates operation of the filter unit. FIG. 12 is a block diagram showing the relationship between the control circuit and each component. FIG. 13 is a flowchart for controlling each fan. Part (a) of FIG. 14 is a sequence diagram of the thermistor in Embodiment 1. Part (b) of FIG. 14 is a sequence diagram of the first fan in the Embodiment 1. FIG. 14 (*c*) is a sequence diagram of the second fan in the Embodiment 1. FIG. 14 (*d*) is a sequence diagram of the third fan in Embodiment 1. Part (a) of FIG. 15 is a first graph showing the effect of the air flow rate control. Part (b) of FIG. 15 is a second graph showing the effect of the air flow rate control. FIG. 15 (*c*) is a third graph showing the effect of the air flow rate control. FIG. 15 (*d*) is a fourth graph showing the effect of the air flow rate control. Part (a) of FIG. 17 is a graph showing the relationship between the suction air flow rate Q (L/min) of the filter unit and "the ratio α (%) of the dust reduced by the operation of the filter unit, and showing a suction air flow rate Q required when α=50% or more. Part (b) of FIG. 17 shows the required suction air flow Q when α=60% or more. FIG. 18 is a graph showing the relationship between the distance d (mm) between the belt 105 and the filter unit inlet port and the suction air flow rate Q necessary for achieving the predetermined a. FIG. 19 is a graph showing the relationship between the distance d (mm) and the required area Fs (cm^2) of the filter 51.

(4-1) Structure of Filter Unit

As shown in part (a) of FIG. 1, the filter unit 50 is located between the fixing unit 101 and the transfer portion 10 in the feeding direction of the sheet P. Or, in the feeding direction of the sheet P, it is positioned between the nip portion 101*b* of the fixing device 103 and the transfer portion 12*a* of the transfer means.

As shown in part (a) of FIG. 1, the filter unit 50 collects the dust D on the filter 51 by suctioning the air including the dust D into the filter 51, which is a nonwoven fabric filter provided in the air inlet 52*a*. As shown in FIGS. 2 and 3, the filter unit 50 includes a filter 51, a first fan 61 as an air intake portion for sucking the air and a duct 52 for guiding the air so that the air in the neighborhood of the sheet entrance 400 passes through the filter 51.

The first fan 61 is an intake portion for sucking the air in the neighborhood of the sheet entrance 400 to the outside of the machine. The first fan 61 is provided in a region outside the passage area of the sheet P in the longitudinal direction of the fixing unit 101. In addition, the first fan is provided in a region outside the nip 101*b* in the longitudinal direction of the fixing unit 101. The first fan 61 has an intake port 61*a* and an exhaust port 61*b*, and produces the air flow to flow from the intake port 61*a* toward the exhaust port 61*b*. The intake port 61*a* is connected to the exhaust port 52*e* of the duct 52 and is an opening for sucking the air in the duct 52. The exhaust port 61*b* is provided toward the outside of the printer 1 and is an opening for discharging the air sucked from the intake port 61*a* to the outside of the printer.

In this embodiment, a blower fan is used as the first fan 61. The blower fan is characterized by high static pressure, and it is possible to assure a constant air flow rate (suction air amount) even with an air flow resistance such as the filter 51.

The duct 52 is a guide portion for guiding the air in the neighborhood of the sheet entrance 400 to the outside of the apparatus. The duct 52 has an inlet opening 52*a* in the neighborhood of the sheet entrance 400 and an outlet opening 52*e* away from the neighborhood of the sheet entrance 400.

The inlet opening 52*a* is an opening positioned between the nip portion 101*b* and the secondary transfer roller 12 and is provided so as to face the nip portion side. With such a structure, the inlet opening 52*a* can receive the dust D carried by the air flow F3 as shown in FIG. 1.

The outlet opening 52*e* is provided in the side surface of the duct 52 on the side opposite to the inlet port 52*a* among the plural side surfaces of the duct 52, in the outside of the air inlet port 52*a* in the longitudinal direction. As described above, the outlet opening 52*e* is connected to the suction port 61*a*.

Further, a filter 51 can be mounted to the duct 52 so as to cover the inlet opening 52*a*. Specifically, the duct 52 includes an edge portion 52*c* of the air inlet opening 52*a* and a rib 52*b* provided with a curved portion 52*d*. When the filter 51 is fixed to the duct 52 so as to be supported by the edge portion 52*c* and the rib 52*b*, the air inlet opening 52*a* is covered by the filter 51. The filter 51 of this embodiment is adhered to the edge portion 52*c* and the rib 52*b* with no gap therebetween by the heat resistant adhesive. Therefore, air passing through the inlet opening 52*a* necessarily passes through the filter 51. The filter 51 of this embodiment is adhered along the curved portion 52*d* of the edge portion 52*c*. In other words, the duct 52 holds the filter 51 in a curved state. At this time, the filter 51 is curved in a direction away from the nip portion 101*b* at a central portion with respect to the widthwise thereof. In other words, the filter 51 projects toward the inside of the duct 52 at its central portion with respect to the lateral direction.

The position of the filter 51 is not limited to the inlet opening 52*a*. For example, as shown in FIG. 20, the filter 51 may be provided at a position deeper than the inlet opening 58 of the duct 57 by a predetermined length H (for example, 3 mm). By placing the filter 51 in such a deep position, it is possible to reduce the risk of an operator inadvertently touching and damaging the filter 51 when a disassembling maintenance operation or the like is performed. However, from the standpoint of downsizing the filter unit, it is better to provide the filter 51 in the air intake as shown in FIG. 1. The position of the filter 51 is to be determined depending on which of the protection of the filter 51 and the downsizing of the filter unit is given the priority.

At this time, in the air flow path inside the duct 57, at least a part of the length ranges A which is the length of the air flow path in the direction perpendicular to the sheet of the drawing of FIG. 20 (the rotation axis direction of the belt 105) in the region from the inlet opening 58 to the filter 51 portion overlaps the range B of the image forming area in the same direction. This relationship also applies to the case where the filter 51 is mounted to the inlet port 52*a* as shown in FIG. 1. Referring to part (b) of FIG. 2, designated by Wf which will be described hereinafter corresponds to the length range A, and Wp-max which will be described hereinafter corresponds to the length range B. Since dust is produced from the toner image formed on the sheet P from the wax transferred onto the belt 105, it is necessary that at least a part of the length range A, which is a range where the dust can be assuredly sucked, overlaps with the length range B.

In this embodiment, the length range A is 350 mm. However, it suffices if the length range A exceeds 200 mm (when the longitudinal direction of the A4 size sheet is the feeding direction) which is the standard maximum image width of the frequently used A4 size sheet. By doing so, it is possible to effectively reduce dust in practical use conditions.

On the other hand, if the length range A is made longer, it is possible to accept a sheet of a larger size. In addition, even when the dust diffuses to the outside of the image forming region due to the surrounding air flow or the like, the dust can be reliably collected by the filter 51. However, if the length range A is too long, the filter 51 sucks the clean air outside the dust production area, which lowers the dust suction efficiency of the filter unit. From the above consideration, it is understood that the upper limit of the length range A is the maximum image width of the maximum size sheet which is usable with a general electrophotographic printer plus the length of the region where dust can diffuse outside.

For example, in the case that the maximum image width is 287 mm provided by excluding the width of about 5 mm in the blank area (non-image area) in the lateral direction from the width of 297 mm of the A4 sheet, and it is assumed that the dust diffuses to the position about 100 mm away from the lateral ends of the maximum image width. In that case, the upper limit of the length range A is appropriate to be 500 mm, which gives some margin to 487 mm which is a value obtained by add in g 200 mm (=100 mm×2) to 287 mm.

In summary, it can be understood that the length range A may be appropriately selected from the range of 200 mm to 500 mm in consideration of the size of the sheet to be used and the degree of diffusion of dust due to air flow. However, assuming use of recording materials of various sizes, the length range A is preferably set to be equal to or more than the width of the minimum width recording material usable with the image forming apparatus. As described above, the filter 51 has a shape extending in the longitudinal direction of the belt 105. By employing such a shape, it is possible to make air passage speed at the inlet opening 52*a* of the duct uniform in the longitudinal direction. In other words, by disposing the filter 51 which is a resistance against the air flow in the air inlet opening 52*a*, it is possible to keep the whole area of the rear region of the filter 51 at a constant negative pressure. In other words, the negative pressures of the points 53*a*, 53*b* and 53*c* shown in part (b) of FIG. 3 are substantially the same. This is because the air flow resistance of the filter 51 is significantly larger than the air flow resistance inside the duct 52. If the negative pressures of the points 53*a*, 53*b* and 53*c* are at the same level, the air flow speed of the air F4 sucked into the filter 51 is made uniform over the entire surface of the filter 51. By this uniformity of the air flow speed, the filter unit 50 can collect the dust D produced from the belt 105 efficiently (with the minimum air flow rate).

When the suction air amount by the filter unit 50 is small, the amount of air flowing into the neighborhood of the belt 105 is also small. Therefore, the temperature drop of the air in the neighborhood of the belt 105 can be reduced. By this, the occurrence of dust D can be suppressed. In addition, it is advantageous in energy saving, because the temperature decrease of the belt 105 can be suppressed.

(4-1-1) Properties of Filter

The filter 51 is a filtering member for filtering (collecting, removing) the dust D from the air passing through the air inlet opening 52*a*. When collecting the dust D produced from the wax, the filter 51 is preferably an electrostatic nonwoven fabric filter. The electrostatic nonwoven fabric filter is a nonwoven fabric formed of fibers holding static electricity, and it is possible to filter dust D with high efficiency.

In the electrostatic nonwoven fabric filter, the higher the fiber density is, the higher the filtration performance is, whereas the pressure loss becomes larger. This relationship is the same also when the thickness of the electrostatic nonwoven fabric is increased. If the charging strength (the strength of static electricity) of the fiber is made high, filtration performance can be improved while keeping the pressure loss constant. The thickness and fiber density of the electrostatic nonwoven fabric and the charge intensity of the fiber are desirably selected appropriately depending on the filtration performance required for the filter. As for the electrostatic nonwoven fabric used for the filter 51 of this embodiment, the fiber density, the thickness and the charging intensity of the electrostatic nonwoven fabric is selected such that the air flow resistance when the passing wind speed is 15 cm/s is about 90 Pa and the filtration rate of the dust is about 80%. There is an upper limit to the charging intensity technically, and when adjusting the performance of the electrostatic nonwoven fabric, it is done by changing the fiber density and the thickness. For example, if the fiber density and thickness are increased, the dust filtration rate can be further increased. However, in such a case the resistance to the air flow becomes high, and it becomes not possible to assure sufficient air flow rate by the pressure generated by a standard blower fan usable with business machines and the like. On the other hand, if the fiber density and the thickness are decreased, the air flow resistance decreases, and it becomes possible to use a fan which is inexpensive and has a low generation pressure performance, but since the filtration rate of the dust also decreases, with the result that it becomes not practical. If the air flow resistance further decreases, unevenness tends to occur in the longitudinal direction with respect to the air flow speed through the filter 51. Specifically, at a position close to the first fan, the air flow speed becomes faster, and at distant places therefrom, it becomes slow with the result that the dust cannot be collected. The air flow resistance is preferably at least 50 Pa. Considering the factors mentioned above, that is, the level of the charge processing technique for the electrostatic nonwoven fabric, the use of a standard blower fan, and the uniformation of the passing air flow speed through the filter 51, the specification range of the electrostatic nonwoven fabric to be used can be properly selected. It can be said specifications around the above-described numerical values, that is, the air flow resistance (Pa) at a passing air speed of 15 cm/s is 50 or more and 130 or less, and the dust filtration ratio is in the range of 60% or more and 90% or less is suitable for use.

When attempt is made to filter the toner in the exhaust air, the electrostatic nonwoven fabric is used with a flow resistance of 10 Pa or less at a passing air speed of 10 cm/s. Therefore, it can be said filter 51 of this embodiment uses an electrostatic nonwoven fabric including a relatively high air flow resistance.

Next, the passing air flow speed Fv through the filter 51 will be described. The faster the passing air flow speed is, the higher the air flow rate per unit time passing through the filter 51 is, and the more the dust can be collected reliably. However, if the passing air flow speed is too high, the temperature of the air in the neighborhood of the sheet entrance 400 is lowered, and as a result, the production amount of the dust D is increased. Furthermore, an increase in the passing air flow speed causes an increase in air flow resistance of the filter 51 and a reduction in the dust filtration ratio.

Therefore, it is desirable to limit the passing air flow speed to 30 cm/s or less, and it is desirable to set it at least 5 cm/s or more from the standpoint of assuring the air flow rate. In other words, the passing air flow speed Fv (cm/s) is preferably 5 or more and 30 or less. In this example, it is an approximate midpoint between 30 cm/s and 5 cm/s. This is the air flow speed set value providing the most balanced air flow speed of 15 cm/s from the standpoint of assuring the air flow rate and filter performance and suppressing the production amount of dust D.

The air velocity of the air passing through the filter 51 and the air flow resistance of the filter 51 were measured by a multi-nozzle fan air flow rate measuring device F-401 (Tsukuba Hiroshi Seiki). The dust filtration ratio of the filter 51 is obtained by measuring the dust concentration upstream and downstream of the filter 51 using Fast Mobility Particle Sizer (FMPS) available from TSI. The difference between the upstream and downstream concentrations is divided by the upstream concentration, and the resulting numerical value expressed in percentage is the dust filtration rate.

(4-1-2) Filter Length

As shown in part (a) of FIG. 2 and part (b) of FIG. 2, the filter 51 has an elongated shape having a longitudinal direction perpendicular to the sheet feeding direction (the direction of the rotation axis of the belt 105 which is a rotatable member). The area indicated by hatching on the sheet P in part (b) of FIG. 2 is an area Wp-max (corresponding to the above-mentioned length range B) in the case of using the sheet P of a predetermined width size. In addition, an image is actually formed on the back side of the sheet P seen in part (b) of FIG. 2. As shown in part (b) of FIG. 2, the region Wp-max is an area equal to or smaller than the width size of the sheet P. In this area, the toner image is formed on the sheet P. In this area, wax adheres to the belt 105, and dust D is produced in this area.

Therefore, as described above, as for the air flow path of the duct 52, at least a part of the length range A in the rotation axis direction of the belt 105 should overlap the length range B of the image forming region in the same direction, that is, Wp-max. Therefore, the length Wf of the filter 51 shown in part (b) of FIG. 2 has to have a length equivalent to the length range A, and it is set to a length exceeding Wp-max.

The fixing device 103 of this embodiment feeds the sheet P in a widthwise center alignment fashion relative to the widthwise center of the belt 105. Therefore, dust D tends to be produced regardless of the width of the sheet in the area Wp-max of the frequently used sheet size. In order to efficiently collect the dust D, the length Wf of the filter 51 needs to exceed the area Wp-max of the sheet size used with high frequency. By this, it is preferable that Wf is larger than the standard maximum image width of 200 mm of the A4 size sheet which is frequently used (when the longitudinal direction of the A4 size sheet is the same as the feeding direction).

(4-1-3) Area and Position of the Filter

The area and position of the filter 51 are important parameters in determining the amount of dust reduction by the filter 51. When it is desired to reduce dust to a large extent, dust may be more effectively sucked by bringing the filter 51 close to the belt 105 as the dust production position, and the area Fs (cm^2) of the filter 51 may be made larger. As shown in part (a) of FIG. 24, the lower the air passing speed Fv of the filter, the lower the filter air flow resistance and the dust filtration ratio rises. This is because if the passing air flow speed Fv decreases, the moving speed of the dust contained in the air also decreases, so that more dust tends to be caught by the fibers of the electrostatic nonwoven fabric constituting the filter. As shown in part (b) of FIG. 24, the passing air flow speed Fv is inversely proportional to the filter area Fs (cm^2). In other words, as the filter area Fs increases, the passing air flow speed Fv decreases and the filter air flow resistance also decreases. If the filter resistance decreases, the air flow rate Q (L/min) of the air sucked into the filter increases when using the same fan, and more dust can be suctioned into the filter 51. Furthermore, the dust filtration ratio of the filter 51 rises as the passing air flow speed Fv decreases. In other words, the dust produced from the printer 1 can be reduced as the filter area Fs is increased. In the following, the relationship between the area and position of the filter and the amount of dust reduction by the filter will be explained in more detail, and a formula for determining the area and position of the filter is derived.

Part (a) of FIG. 17 and Part (b) of FIG. 17 show the relationship between the suction air flow rate Q and the dust reduction rate α in the filter unit 50 obtained by experiments. The dust reduction rate α is expressed by the following equation based on the dust amount Do produced from the printer 1 when the filter 51 is not used and the dust amount De reduced by using the filter 51.

$$\alpha(\%)=De/Do\times 100$$

From part (a) of FIG. 17 and part (b) of FIG. 17, it is understood that as the suction air flow rate Q increases, the dust reduction rate α also increases. This is because the dust D produced from the belt 105 is more suctioned into the filter 51 as the suction air flow rate Q rises.

Also, three lines (Line A, Line B, Line B) are shown in the Figure depending on the length of the filter (the length in the rotation axis direction of the belt 105) Wf (mm) and the distance d (mm) between the belt 105 and the filter 51). As shown in FIG. 20. The distance d means the distance between the surface of the belt 105 and the center 57*c* of the inlet opening 58 of the duct 57 (midpoint between the end portions 57*a* and 57*b* of the inlet opening). Referring to the example in FIG. 1, the center 57*c* in FIG. 20 corresponds to the center 50*d* in FIG. 1, and the end portions 57*a* and 57*b* correspond to 50*b* and 50*c* respectively.

Comparing Line A and Line B in FIG. 17, both Wf are 350 mm, and d are 20 mm and 35 mm, respectively. Line A corresponding to d=20 exceeds Line B corresponding to d=35 because the dust produced from the belt 105 can be more effectively suctioned as the filter 51 is closer to the belt 105.

Line C is a line when the length Wf of the filter 51 is 40 mm which is shorter than the length of the image forming area. Under the condition of Line C, Line C is significantly lower than Line A and Line B because only the central part of the dust production region (the region through which the image passes and toner wax adheres) on the belt 105 is suctioned to the filter 51.

Part (a) of FIG. 17 shows that when α≥50%, the required suction air flow rate Q is 16.3 L/min or more in the case of d=20 mm (Line A), and is 35 L/min or more in the case of d=35 mm (Line B). Part (b) of FIG. 17 shows that when α≥60%, the required suction air flow rate Q 35 L/min or more in the case of d=20 mm (LineA), and is 78.4 L/min in the case of d=35 mm (Line B) min or more. α≥50% is a numerical value which is an index when considering the dust reduction target by the filter.

This is because in many electrophotographic printers, if the dust is reduced by about 50%, it is possible to effectively prevent problems such as image defects due to dust contamination inside the apparatus. However, in some printers, sufficient effect cannot be obtained unless it is set to a 60%. In this example, therefore, the required suction air flow rate Q when α≥60% is estimated in part (b) of FIG. 17. The filter 51 used in the experiment has an air flow resistance of about 90 Pa at a passing air flow speed of 15 cm/s, and the dust filtration ratio is about 80%.

Next, FIG. 18 will be described. FIG. 18 shows the relationship between the suction air flow rate Q (L/min) and the distance d (mm) required to achieve the target dust reduction rate a obtained on the basis of the parts (a) and (b) of FIG. 17. When the target α=50%, Q=16.5 in the case of d=20, and Q=35 in the case of d=35. The line connecting them is represented by Q=1.25×d−8.67. Similarly, when the target α=60%, Q=2.89×d− 22.9. And when you want to set a to 50% or more, or 60% or more, the following relations apply because Q can be made larger.

$$\alpha\geq 50\%:\ 1.25\times d\ (\mathrm{mm})-8.67\leq Q\ (\mathrm{L/min})$$

$$\alpha\geq 60\%:\ 2.89\times d\ (\mathrm{mm})-22.9\leq Q\ (\mathrm{L/min})$$

If the suction air flow rate Q is too large, excessive heat of the surface of the belt 105 is taken away. When heat is excessively taken away, the control circuit A supplies electric power to the heater 101*a* accordingly, with the result that the power consumption of the entire printer 1 is increased. From the standpoint of suppressing power consumption, the suction air flow rate Q is preferably set to 200 L/min or less. If this condition is added to the above equation, the following equation can be obtained.

$$\alpha\geq 50\%:\ 1.25\times d\ (\mathrm{mm})-8.67\leq Q\ (\mathrm{L/min})\leq 200$$

$\alpha \geq 60\%$: $2.89 \times d$ (mm) $-22.9 \leq Q$ (L/min) $\leq 200$

Next, the filter area Fs (cm^2) is determined. The filter area Fs (cm^2) is determined by the filter passing air flow speed Fv (cm/s).

$$Q\ (\mathrm{L/min}) = Fs\ (\mathrm{cm}^2) \times Fv\ (\mathrm{cm/s})/1000 \times 60.$$

$$Fs\ (\mathrm{cm}^2) = Q\ (\mathrm{L/min})/Fv\ (\mathrm{cm/s}) \times 1000/60.$$

By rewriting the expression describing the range of Q described above into the expression using Fs by the above equation, the following for determining the position and area of the filter can be obtained.

$\alpha \geq 50\%$:

$$(1.25 \times d - 8.67) \times \frac{1000}{Fv \times 60} \leq Fs < 200 \times \frac{1000}{Fv \times 60}$$

$\alpha \geqq 60\%$:

$$(2.89 \times d - 22.9) \times \frac{1000}{Fv \times 60} \leq Fs < 200 \times \frac{1000}{Fv \times 60}$$

Here, if the passing air flow speed Fv is 15 cm/s, Fs is expressed by the following expression.

$\alpha \geqq 50\%$:

$$(1.25 \times d - 8.67) \times \frac{1000}{15 \times 60} \leq Fs < 200 \times \frac{1000}{15 \times 60}$$

$$(1.25 \times d - 8.67) \times \frac{10}{9} \leq Fs < 200 \times \frac{10}{9}$$

$\alpha \geqq 60\%$:

$$(2.89 \times d - 22.9) \times \frac{1000}{15 \times 60} \leq Fs < 200 \times \frac{1000}{15 \times 60}$$

$$(2.89 \times d - 22.9) \times \frac{10}{9} \leq Fs < 200 \times \frac{10}{9}$$

FIG. 19 is a graph showing the range of the above equation. When it is desired that the dust filtration ratio α is 50% or more, Fs and d may be set to fall within the range 1 in the Figure. When it is desired that the dust filtration ratio α is 60% or more, it is only necessary to set Fs and d to fall within the range 2 in the Figure.

Apart from the range of d determined by the above formula, there is a limitation that requires attention for the value of d. If the filter 51 and the belt 105 are brought too close to each other, there is a possibility that the filter 51 thermally deteriorates due to the radiation from the belt 105 and the filtering performance is deteriorated. Therefore, it is desirable that the filter 51 is disposed at an appropriate distance from the nip portion 101*b*. Specifically, the distance d (shortest distance) between the filter 51 and the belt 105 is desirably 5 or more and 100 or less.

(4-1-4) Curved Surface Shape of Filter

As described above, when the filter 51 is disposed in the neighborhood of the belt 105, the distance between the filter 51 and the fed sheet P decreases. Therefore, if the conveyance of the sheet P is disturbed, the air intake surface 51*a* of the filter 51 may contact the sheet P. When the filter 51 and the sheet P contact with each other, the toner image on the sheet P may be disturbed. Further, the filter 51 may be damaged by the sheet P, and collecting efficiency of the dust D may decrease.

Therefore, in this embodiment, a structure which suppresses contact between the sheet P and the filter 51 is employed.

As for a disorder of the conveyance of the sheet P, there is a phenomenon-called a trailing end flap of the sheet P. The trailing end flap is a phenomenon-in which the trailing end Pend is greatly displaced in the direction of V in the drawing when the trailing end Pend of the sheet P nipped and fed by the nip portion 101*b* passes through the transfer portion 12*a*.

The trailing end flap is likely to occur when the shape of the original sheet P is deformed (curled). Further, even when the sheet P is a thin sheet including low rigidity, the sheet P is deformed along the shape of the nip portion 101*b*, so that the trailing end flap is likely to occur.

In order to accommodate this trailing end flap, the filter 51 is disposed as shown in part (a) of FIG. 1 in this embodiment. More particularly, the widthwise end portion of the filter 51 on the downstream side in the sheet feeding direction is more remote from a feeding path provided by linearly connecting the nip portion 101*b* and the transfer portion 12*a* with each other, than upstream end portion. With such a structure, even if the trailing end portion Pend of the sheet P passed through the transfer portion 12*a* gradually displaces in the V direction as the sheet advances, the filter 51 and the sheet P are hard to come into contact to each other. In this embodiment, the filter 51 is curved in a direction away from the feeding path of the sheet P. With such a structure, the distance between the belt 105 and the filter 51 is maintained at a short distance while accommodating the trailing end flap.

In addition, when the filter 51 has such a curved shape, the surface area of the filter 51 can be increased within a limited space. As the surface area of the filter 51 increases, the dust D and the filter 51 are more likely to come into contact with each other, so that the collecting efficiency of the dust D is improved.

(4-2) Air Flow Structure

Next, the air flow in the printer will be described. In order to collect the dust D efficiently, it is desirable to properly control the air flow in the printer, particularly the air flow around the fixing device 103. The structure related to the air flow around the fixing device 103 will be described in detail below.

(4-2-1) First Fan

As described above, when the air flow rate of the first fan 61 is large, air can be sucked more, whereas the temperature of the air in the neighborhood of the sheet entrance 400 is easily reduced. In other words, if the air flow rate of the first fan 61 is high, it is easy to produce a lot of dust D while collecting a lot of dust. Therefore, in order to efficiently reduce the dust D by the filter unit 50, it is desirable to maintain the air flow rate of the first fan 61 at an appropriate level. The collection of the dust D by the suction of the first fan 61 is called a dust collecting action and the increase of the amount of dust produced by the suction of the first fan 61 is called the dust increasing action.

Here, a test was conducted to verify the relationship between the air flow rate of the first fan 61 and the production amount of the dust D. In the test, the amount of dust D discharged from the printer during the image forming process is measured. In detail, the printer 1 installed in a chamber executes the image forming process, and the entire exhaust of the printer is acquired. Then, the discharged air is sampled by the nanoparticle size distribution analyzer and the discharge amount of dust D is measured. This test is performed a plurality of times while varying the air flow rate of the first fan 61 during the image forming process. In this case, the tests conducted in several ways are called Test A, Test B, Test C and Test D.

In test A, the amount of dust D discharged outside the fixing device is measured while the first fan 61 is operated at full speed during the image forming process. In Test B, the amount of dust D discharged to the outside of the fixing device is measured while the first fan 61 is at rest during the image forming process. In test C, the amount of dust D discharged to the outside of the fixing device is measured in the state when the first fan is operated at the minimum speed at which it can operate normally (7% of the full speed air flow rate) during the image forming process. In Test D, the amount of dust D discharged to the outside of the fixing device is measured while the first fan is operated at a speed of 20% of the full speed air flow during the image forming process.

Part (b) of FIG. 15 shows the relationship between the elapsed time after the start of printing and the amounts of produced dust D in Test A and Test B. Part (b) of FIG. 15 shows the relationship between the elapsed time after the start of printing and the production amounts of dust D in test B and test C. Part (C) in FIG. 15 shows the relationship between elapsed time after the start of printing and production amounts of dust D in test C and test D. Part (D) of FIG. 15 shows the relationship between the elapsed time after the start of printing and the production amounts of dust D in Test B and in this embodiment (E).

Designated by (A) is the relationship between the elapsed time from the start of the image forming process and the discharge amount of dust D in Test A. Designated by (B) is the relationship between the elapsed time from the start of the image forming process and the discharge amount of dust D in the test B. Designated by (C) is the relationship between the elapsed time from the start of the image forming process and the discharge amount of dust D in the test C. Designated by (D) is the relationship between the elapsed time from the start of image formation processing and the discharge amount of dust D in test D.

According to part (a) of FIG. 15, (A) exceeds the dust discharge amount of (B) until about 70 seconds after the start of printing, after that (A) falls below the dust discharge amount of (B). This means that the dust increasing action exceeds the dust collecting action until about 70 seconds after the start of printing. As described above, the smaller the air flow rate of the first fan 61 is, the smaller the dust increasing action is. Therefore, if the air flow rate of the first fan 61 is lowered from the state of the test A, the dust collecting action at the initial stage of printing should exceed the dust increasing sooner or later.

By the investigations of the inventors, it has been found that when the air flow rate of the first fan 61 is reduced to 10% of the full speed air flow rate (the air passing air flow speed of the filter 51 is 5 cm/s), the dust collecting action at the beginning of printing exceeds the dust increasing action.

In part (b) of FIG. 15, (B) exceeds the dust discharge amount of (C) during the entire period after the start of printing. This means that the dust collecting action always exceeds the dust increasing action in (B).

In FIG. 15 (*c*), (D) exceeds the dust discharge amount of (C) until 90 seconds after the start of printing, and the dust discharge amount becomes almost equivalent for a while after that. And, (D) becomes less than the dust discharge amount of (C) from around 150 seconds after the start of printing.

From this, it is understood that the discharge amount of the dust D can be reduced by operating the first fan 61 at an air flow rate of 7% from the start of printing until 90 seconds (predetermined time), by operating the first fan 61 at 20% air flow rate from 150 seconds after the start of printing. In other words, it is desirable to operate the first fan 61 with a small flow rate at the initial stage after the start of printing, and to increase the air flow rate of the first fan 61 with the lapse of time. Based on the results described above, in this embodiment, the air flow rate of the first fan 61 is controlled. As shown in part (b) of FIG. 14, in this embodiment, the first fan 61 is operated at an air flow rate of 7% until 90 seconds after the start of printing. This air flow rate is not less than the air flow rate when the fan 61 is rotated at the minimum speed (above the suction air amount) and not more than 10% of the air flow rate when the fan 61 is rotated at the maximum speed. The first fan 61 is operated at 20% air flow rate from 90 seconds to 390 seconds after the start of printing. The first fan 61 is operated at 100% after 390 seconds from the start of printing. Designated by (E) is the relationship between elapsed time from the start of image formation process and discharge amount of dust D in this example.

According to part (d) of FIG. 15, in this embodiment, the discharge amount of dust D is less than a half as compared with test B. In other words, in this example, it is possible to halve the discharge amount of dust D during the period from the beginning of image formation to 600 seconds.

(4-2-2) Second Fan and Third Fan

When the sheet P containing moisture is heated by the fixing device 103, water vapor is produced from the sheet P. Because of this water vapor, space C is in a state of high humidity. The space C is a region on the downstream side of the fixing device 103 in the sheet feeding direction and on the upstream side of the discharge roller 14. Since the dew condensation tends to produce easily when the humidity of the space C is high, it is easy for water droplets to adhere to the guide member 15. When water droplets on the guide member 15 adhere to the fed sheet P, image defects occur.

Therefore, when the humidity in the space C increases due to the water vapor produced from the sheet P, it is desirable to reduce the humidity.

The second fan 62 is for preventing dew condensation from being produced on the guide member 15.

The second fan 62 suction the air from the outside of the printer 1 into the machine and blows the air onto the guide member 15, thereby lowering the humidity in the space C. In detail, since the water vapor in the neighborhood of the guide member 15 diffuses around the space C by the air blowing from the second fan 62, the local increase in humidity in the neighborhood of the guide member 15 is suppressed. Even when only the second fan 62 is used, condensation on the guide member 15 can be suppressed for a certain period. However, since the discharge destination of the steam is only the gap provided around the discharge roller pair 14, the humidity in the space C gradually increases. Therefore, in this embodiment, the water vapor expelled from the space C by the spray from the second fan 62 is discharged out of the machine by the third fan 63.

As shown in part (a) of FIG. 2, the third fan 63 produces the air flow 63*a* around the fixing device 103. The third fan 63 has a function of discharging water vapor and hot air in the space C to the outside of the machine by the air flow 63*a*. On the other hand, the third fan 63 may suck out the dust D in the neighborhood of the nip portion 101*b* of the belt 105 and discharge it outside the filter without passing through the filter.

An additional filter may be provided downstream of the third fan 63 in order to reduce the dust D discharged to the outside of the image forming apparatus by the third fan 63.

However, if a filter is mounted to the third fan 63, exhaust will be obstructed by the air flow resistance of the filter. Therefore, it is difficult to sufficiently discharge the heat and water vapor in the space C to the outside of the machine.

Therefore, in this embodiment, the air flow in the machine of the printer 1 is adjusted so that the dust D can be prevented from being drawn toward the third fan 63. Specifically, the air pressure in the printer 1 is controlled so that the air pressure in the space on the downstream side of the fixing device 103 in the sheet feeding direction is higher than the air pressure in the space on the upstream side of the fixing device 103 in the sheet feeding direction. In addition, even if the air flow is adjusted as described above, the dust D is drawn into the third fan 63 for a short time. Therefore, in the initial stage of the image formation process where the amount of produced dust D is large (see part (b) of FIG. 9), the operation of the third fan 63 is suppressed to suppress the discharge of the dust D. When the production of dust D decreases due to the progress of the image forming process, the third fan 63 is operated to discharge water vapor and hot air in the space C to the outside of the machine.

The period during which the operation of the third fan 63 is suppressed is a period of time in which no thermal problem occurs in the printer 1. Since the respective components in the image forming apparatus are not sufficiently heated at the beginning of the image forming process, there is no problem even if exhaust heat is not performed in about several minutes. As mentioned above, dew condensation can be prevented only with the second fan 62 in a period of about several minutes.

(4-3) Control Flow

As described above, the dust D is easy to produce in the neighborhood of the sheet entrance 400. However, some dust D may be produced in the neighborhood of the sheet exit 500. A part of the dust D existing in the neighborhood of the fixing device 103 may be fed to the space C on the downstream side in the sheet feeding direction than to the fixing device 103, as the sheet P is conveyed. Or, a part of the dust D produced in the neighborhood of the sheet entrance 400 may be fed to the space C by thermal convection.

Such a part of the dust D is difficult to collect by the filter unit 50 and adheres to a member on the downstream side in the sheet feeding direction or is discharged outside the apparatus, rather than adhering to the fixing device 103, As the member on the downstream side in the sheet feeding direction, the guide member 15 and the discharge roller pair 14 can be employed. When dust D adheres to these members, it causes a defective image. Therefore, when collecting the dust D using the filter unit 50, it is desirable to confine the dust D in the neighborhood of the filter unit 50 in order to improve the collecting efficiency. In other words, it is desirable to adjust the air flow in the image forming apparatus so that the dust D does not go to the downstream side in the sheet feeding direction beyond the fixing device 103.

Therefore, in this embodiment, the second fan 62 and the third fan 63 are controlled in addition to the above-described control of the first fan 61 during continuous image formation. Each fan is desirably appropriately controlled according to the temperature condition around the fixing device 103. In this embodiment, the temperature state of the periphery of the fixing device 103 is estimated on the basis of the time elapses from the start of printing, and in the first period, the second period, and the third period of the image forming processing operation, different fan controls are carried out.

The first period is a period from the start of the image forming process to the first predetermined time (for example, 90 seconds). In other words, the first period is a period from the passage of the first sheet P in the continuous process of image formation to the predetermined time after passing through the nip portion 101*b*. In other words, the first period is a period from the passage of the first sheet P in the continuous process of image formation to the predetermined time after passing through the nip portion 101*b*.

The second period is a period from the elapse of the first predetermined time to the second predetermined time (for example, 360 seconds). The third period is after the second predetermined period has elapsed. In this embodiment, the elapsed time from the start of the printer is measured by a timer portion of the control circuit A.

The method of acquiring the elapsed time from the start of printing is not limited to the timer portion. For example, the control circuit A may acquire the elapsed time from the start of printing based on the counter unit that counts the number of sheets processed. Therefore, the period from the start of the image forming process to the execution of the image forming process on the first predetermined number of sheets (for example, 75 sheets) may be defined as the first period. In other words, the period until the first predetermined number (for example, 75) of sheets P passes through the nip portion 101*b* after the first sheet P of the continuous process of image formation passes through the nip portion 101*b* is defined as the first period. The period from the execution of the image forming process on the first predetermined number of sheets P until the image forming process is performed on the second predetermined number (eg 300 sheets) of sheets P may be defined as the second period. The period after the second predetermined number of sheets P is subjected to image forming processing may be defined as the third period.

When there is a temperature sensor capable of detecting the ambient temperature of the fixing device 103, it is not necessary to estimate the ambient temperature of the fixing device 103. Therefore, the control circuit A does not have to acquire the elapsed time from the start of printing. In the case where such a temperature sensor is provided, step S107 is executed when the detected temperature reaches the first predetermined temperature, and the detected temperature becomes the second predetermined temperature higher than the first predetermined temperature, step S109 may be executed.

The second fan 62 functions as a blower for blowing air to the space C above the fixing device 103, and the third fan 63 sucks air from the space C above the fixing device 103, as an air flow portion (exhaust portion) for discharging the air to the outside of the image forming apparatus.

Hereinafter, the operation sequence of each fan will be described in detail referring to FIGS. 13 and 16. Part (a) of FIG. 16 is a sequence diagram of the thermistor TH in the Embodiment 2. Part (b) of FIG. 16 is a sequence diagram of the first fan in the Embodiment 2. FIG. 16 (*c*) is a sequence diagram of the second fan in the Embodiment 2. FIG. 16 (*d*) is a sequence diagram of the third fan in the Embodiment 2.

When the power of the printer 1 is turned on (power is turned on), the control circuit A executes the control program (S101).

Upon receiving the print command signal, the control circuit A advances the process to S103 (S102). The control circuit A acquires the output signal of the thermistor TH and if the detected temperature is equal to or lower than a predetermined temperature (for example, 100° C.) (YES), the control circuit A advances the process to S104, If it is higher than a predetermined temperature (for example, 100° C.) (NO), the process proceeds to S112 (S103).

In step S103, it is determined whether or not the interior of the printer 1 is cold, in particular, whether or not the ambient temperature of the fixing device 103 is low. In other words, the control circuit A functions as an acquiring portion for acquiring information on the ambient temperature of the fixing device 103 from the thermistor TH.

The control circuit A may acquire information on the peripheral temperature of the fixing device 103 from other than the thermistor TH. For example, if there is a temperature sensor that can detect the ambient temperature of the fixing device 103, the control circuit A may acquire information from this temperature sensor.

When the step proceeds to S112, the control circuit A sets the second fan 62 and the third fan 63 to the full speed air flow rate of 100(%) with the start of printing. And, the control circuit A stops the operations of the second fan 62 and the third fan 63 (S112).

When the detected temperature of the thermistor TH is higher than 100° C. At the start of printing, the ambient temperature of the fixing device 103 is considered to be sufficiently high. Therefore, the amount of dust D produced is small. Therefore, in this embodiment, the first fan 61 is not operated. However, in order to collect the minute dust D, the first fan 61 may be operated. At this time, if the air flow rate of the first fan 61 is 100(%) of the full speed air flow rate, the collecting efficiency of the dust D is high, which is preferable.

When the detected temperature of the thermistor TH at the start of printing is lower than 100° C., it is considered that the ambient temperature of the fixing device 103 is low. When the ambient temperature of the fixing device 103 is low, dew condensation tends to occur in the guide member 15 when printing is started, and dust D is easy to produce. Therefore, it is required to solve each of these problems.

When the step advances to S104 and printing is started, the control circuit A sets the air flow rate of the first fan 61 to 7(%) and the air flow rate of the second fan to 100(%) (S104, S105).

When the step advances to S105 and the first time period (for example, 90 seconds) elapses from the start of printing (YES), the control circuit A advances the step to S107 (S106). If not (NO), the control circuit A maintains the air flow rate of each fan.

When the step proceeds to S107, the control circuit A sets the air flow rate of the first fan 61 to 20(%) and the third fan 63 to 100(%). At this time, if the air flow rate of the third fan 63 exceeds the sum of the air flow rate of the first fan 61 and the air flow rate of the second fan 62, the dust D is sucked into the third fan 63. Therefore, in this embodiment, the air flow rate of the second fan is maintained at "100" so that the air flow rate of the third fan 63 is lower than the sum of the air flow rate of the first fan 61 and the air flow rate of the second fan 62. In other words, when the air flow by the first fan 61 and the air flow by the third fan 63 are performed in parallel, the second fan has an air flow rate larger than the air flow rate of the difference between the air flow rate of the third fan and the air flow rate of the first fan.

When the second time period (for example, 90 seconds) elapses from the start of printing (YES), the control circuit A advances the step to S109 (S108). If not (NO), the control circuit A maintains the air flow rate of each fan.

When the third time (for example, 390 seconds) elapses from the start of printing (YES), the control circuit A advances the step to S109 (S108). If not (NO), the control circuit A maintains the air flow rate of each fan.

When the step proceeds to S109, the control circuit A sets the air flow rate of the first fan 61 to 100(%) and proceeds to S110 (S109).

When printing is completed (S110), the control circuit A stops all of the first fan, the second fan and the third fan (S111).

When about 10 minutes elapses from the start of the image forming process, the amount of dust D produced remarkably decreases. Therefore, if printing is executed for a long time after the step S109, the air flow of the first fan 61 may be stopped (OFF) without waiting for the end of printing.

In this embodiment, during execution of the image forming process, the second fan 62 having a large air flow rate is constantly operated at full speed. Therefore, the space C is always in a positive pressure state. Therefore, dust D from the sheet entrance 400 does not easily flow into the space C. In this embodiment, the third fan is operated during the execution of the image forming process. However, since the air flow rate of the third fan 63 is equal to or less than the sum of the air flow rate of the second fan 62 and the air flow rate of the first fan 61, the space C can be maintained at a positive pressure.

Further, in this embodiment, the air flow rate of the third fan at the start of printing is set to 0 (OFF), but as shown in FIG. 16, the air flow rate of the third fan may be set to 50(%). Even in this case, the air flow rate of the third fan 63 is not more than the sum of the air flow rate of the second fan 62 and the sum of the first fan 61. Therefore, it is possible to place the space C in a positive pressure state. By doing this, it is possible to assuredly prevent the dew condensation around the guide member 15, and to further suppress the temperature rise of the peripheral device of the fixing device 103.

The air flow rate of the first fan 61 is smaller than the air flow rate of the second fan 62 and smaller than the air flow rate of the third fan 63. In this embodiment, the air flow rate when operating the first fan 61 at 100% is 5 l/s, and the air flow rate when operating at 7% is 0.5 l/s. When the second fan 62 is operated at 100%, the air flow rate is 10 l/s. The air flow rate when operating the third fan at 100% is 10 l/s. Even if the first fan 61 is operated at full speed, the air flow rate of the first fan 61 is smaller than the air flow rate of the second fan 62 and the third fan 63. Therefore, the atmospheric pressure state of the space C is dominantly controlled by the second fan 62 and the third fan 63. In other words, by controlling the second fan 62 and the third fan 63, the control circuit A can suppress the flow of the dust D in the space C.

According to this embodiment, it is possible to efficiently collect the dust D by sucking the air in the neighborhood of the nip portion 101*b* uniformly along the longitudinal direction of the nip portion 101*b*. According to this embodiment, it is possible to suppress the air suction from being locally strengthened in the neighborhood of the nip portion 101*b*, and suppress the local temperature decrease of the fixing belt 105. According to this embodiment, in the neighborhood of the nipping portion 101*b*, the air at the end portion in the longitudinal direction of the nip portion 101*b* can be assuredly sucked and the dust D on the end portion side in the longitudinal direction of the nipping portion 101*b* can be assuredly collected.

According to this embodiment, the air in the neighborhood of the belt 105 is sucked in such a manner that it does not cool too much, and the occurrence of the dust D can be suppressed. According to this embodiment, the dust D can be efficiently collected depending on the temperature in the neighborhood of the belt 105.

According to this embodiment, it is possible to control the air flow in the image forming apparatus to suppress the dust D from flowing out to the downstream side of the fixing device 103.

According to this embodiment, the dust D is confined in the neighborhood of the sheet entrance 400 of the fixing device 103, and the dust D can be efficiently collected by the filter unit 50.

Embodiment 2

Next, Embodiment 2 will be described. FIG. 21 is a view showing a relationship between a disposition of the filter unit and radiant heat E in Embodiment 2. FIG. 22 is a view showing a relationship between a disposition of the filter unit and radiant heat E in first modified example 1. FIG. 23 is a view showing a relationship between a disposition of the filter unit and radiant heat E in second modified example 2.

In Embodiment 1, in order to improve the collection efficiency of the dust D, the inlet opening 52*a* of the duct 52 and the filter 51 are oriented toward the nip portion 101*b* (toward the belt 105). On the other hand, in Embodiment 2, by directing the suction opening 52*a* of the duct 52 toward the transfer portion 12*a* side, excessive heating of the filter 51 is suppressed. The printer 1 of the Embodiment 2 is the same as the Embodiment 1 except that the disposition of the filter unit 50 is different. Therefore, the same reference numerals are given to similar structures, and the detailed explanation thereof is omitted.

Although a nonwoven fabric or the like is used as the filter 51 used for collecting the dust D, the nonwoven fabric may be thermally deteriorated in a high temperature environment in some cases. If the thermal deterioration of the filter 51 is promoted, the life of the filter 51 is reduced. Then, it is required to exchange the filter frequently. However, replacing the filter 51 with high frequency not only is cumbersome, but also increases the running cost. Therefore, it is desirable that the filter 51 is not heated too much.

One cause of the temperature rise of the filter 51 is the heat of the air near the sheet entrance 400. However, the filter 51 is intended to collect the dust D from the air in the neighborhood of the sheet entrance 400, and has a sufficient heat resistance to the air temperature in the neighborhood of the sheet entrance 400. Therefore, the reduction of the life of the filter 51 is not promptly promoted only by the heat of the air near the sheet entrance 400.

Another cause of the temperature rise of the filter 51 is radiant heat E from the fixing unit 101. Radiant heat E is the heat which is directly transmitted in the form of electromagnetic waves from a high temperature solid surface to a low temperature fixed surface. The filter 51 is located in the neighborhood of the fixing unit 101 which is a heat source. For this reason, the influence of the radiant heat E from the fixing unit 101 is significant.

In other words, the intake surface 51*a* of the filter 51 is brought to a high temperature state by radiant heat E irradiated from the fixing unit 101 in addition to the temperature rise due to the heat of the air in the neighborhood of the sheet entrance 400.

Therefore, in this embodiment, the life of the filter 51 is improved by reducing the radiant heat E from the fixing unit 101 to the filter 51.

In the fixing unit 101, the member which radiates the radiant heat E most strongly is the belt 105 having the highest temperature. Radiant heat E radiated from the belt 105 radially diffuses from every point on the surface layer of the fixing belt 105. Therefore, in order to reduce the temperature rise of the filter 51, the filter 51 may be disposed at a position where the radiant heat E from the belt 105 is not irradiated on the intake surface 51*a*.

Therefore, in this embodiment, the inlet port 52*a* of the duct 52 is disposed facing the transfer portion 12*a* side (the transfer roller 12 side). Since the filter 51 is provided so as to cover the air inlet port 52*a*, in the above-described structure, the surface of the filter 51 faces the transfer portion 12*a* side (the transfer roller 12 side). The space between the belt 105 and the filter 51 is blocked by the duct 52.

Referring to FIG. 21, the positional relationship between the belt 105, the filter 51, and the duct 52 will be described in detail. The contact point between the deposition surface 51*a* and the duct upper wall is referred to as M1, and the contact point with the duct lower wall is referred to as N1. The contact point with the surface layer of the belt 105 when the line M1-N1 connecting M1 and N1 is extended to the surface layer of the fixing belt 105 is referred to as L1. In order to make it hard for the radiant heat E to be directed to the filter 51, it is desirable that the position of the contact point L1 is within the range of the region 135*d*. When the fixing belt 105 is divided into four regions in the circumferential direction, the region 135*d* is the fourth region counted from the nip part 101*b* along the rotational direction.

In this embodiment, the line L1-N1 is the tangent of the belt 105 at the contact point L1. In such a structure, the radiant heat E from the belt 105 does not go to the intake surface 51*a*. Therefore, temperature rise of the filter 51 can be suppressed.

The angle of the inlet port 52*a* may be made steeper so that the extension line of the line M1-N1 does not intersect the belt 105. Even with such a structure, the radiation heat E from the belt 105 does not go to the filter 51. For example, as in modified example 1 shown in FIG. 22, the angle of the inlet port 52*a* may be made steeper to block radiant heat E from the pressure roller 102.

The point of contact with the surface layer of the pressure roller 102 when the line M1-N1 is extended to the surface layer of the pressure roller 102 is referred to as L2. It is desirable that the position of the contact point L1 is within the range of the region 135*d* in order to make it hard for the radiant heat E to go toward the air intake surface 51*a*. When the pressure roller 102 is divided into four regions in the circumferential direction, the region 135*e* is the third region counted from the nip part 101*b* along the rotational direction. In the modified example 1, the line L2-N1 is the tangent line of the pressure roller 102 at the contact point L2. With such a structure, the radiation heat E of the belt 105 and the radiation heat E' from the pressure roller 102 are not directed to the suction surface 51*a*. Therefore, the temperature rise of the filter 51 can be suppressed.

The filter 51 is not necessarily inclined with respect to the sheet feeding direction. For example, as in modified example 2 shown in FIG. 23, the filter 51 may be disposed so as to be parallel to the feeding direction of the sheet P. In this case, it is desirable to provide the shielding portion 55 in the duct 52 so that the radiant heat E does not go to the filter 51.

The contact point between the filter 51 and the feeding surface side end of the duct upper wall is referred to as M3 and the contact point between the filter 51 and the duct lower wall is referred to as N3. The contact point with the surface layer of the belt 105 when the line M3-N3 connecting M3 and N3 is extended to the surface layer of the fixing belt 105 is L3. In order to make radiant heat E hard to reach the filter 51, it is desirable that the position of the contact L3 is within the range of the region 135*d*. In this embodiment, the line L3-N3 is a tangent to the belt 105 at the contact L3. In such a structure, the radiant heat E from the belt 105 does not go to the intake surface 51*a*. Therefore, the temperature rise of the filter 51 can be suppressed.

According to this embodiment, the temperature rise of the filter 51 can be suppressed. According to this embodiment, it is possible to suppress a decrease in the life of the filter 51. According to this embodiment, it is possible to reduce the filter replacement frequency. However, the structure of the Embodiment 1 is preferable in that the dust D can be surely collected.

Other Embodiments

Although the present invention has been described with the embodiments, the present invention is not limited to the structures described in the embodiments. The numerical values such as the dimensions exemplified in the examples are merely examples and may be appropriately selected within the range where the effect of the present invention can be provided. In addition, as long as the effect of the present invention is provided, a part of the structure described in the embodiment may be replaced by another structure having the same function.

The suction surface 51*a* of the filter 51 does not have to have a curved shape, and the suction surface 51*a* may have a planar shape, so that it can collect the dust D. As the filter 51, another filter such as a honeycomb filter may be usable instead of the non-woven fabric filter. In the case of using an electrostatic filter which is a nonwoven fabric filter electrostatically treated as the filter 51, the dust D may be charged by the charging device and collected by the filter 51. The disposition and the structure of the filter 51 are not limited to those described in the embodiments. For example, two or more filters 51 may be provided at respective end portions of the belt 105 in the longitudinal direction. The filter 51 may be provided on the pressure roller side with respect to the sheet feeding path.

The structure of the fixing device 103 is not limited to the structure in which the sheet is fed in the vertical path. For example, the fixing device 103 may be constituted to feed a sheet in a horizontal path or obliquely.

The heating rotary member for heating the toner image on the sheet is not limited to the belt 105. The heating rotary member may be a roller or a belt unit in which a belt is extended around a plurality of rollers. However, the structure of the Embodiment 1, in which the surface of the heating rotatable member becomes high temperature and the dust D is easily produced, can provide a large effect.

The nip forming member forming the nip portion and the heating rotator is not limited to the pressure roller 102. For example, a belt unit in which a belt is extended around a plurality of rollers may be used.

The heating source for heating the heating rotator is not limited to a ceramic heater such as the heater 101*a*. For example, the heating source may be a halogen heater. In addition, the heating rotatable member may be caused to directly generate electromagnetic induction heat. Even with such a structure, the dust D tends to be produced near the sheet entrance 400, and therefore, the structure of the Embodiment 1 can be applied.

The image forming apparatus described in the foregoing as a example of the printer 1 is not limited to a image forming apparatus which forms a full color image, but may be a image forming apparatus which forms a monochrome image. In addition, the image forming apparatus can be implemented in various applications such as copying machine, facsimile machine, multifunction machine having a plurality of the functions of these machines, add in g necessary equipment, equipment and casing structure.

INDUSTRIAL APPLICABILITY

According to the present invention, there is provided a image forming apparatus capable of appropriately removing fine particles produced from parting material contained in toner.

DESCRIPTION OF REFERENCE NUMERALS

12*a*: contact portion
15, Guide member
50: Filter unit
51: Filter
52: duct
52*a*: inlet port
61: First fan
62: Second fan
63: third fan
101: Fixing belt unit
101*a*: Heater
101*b*: nipping portion
102: pressing roller
103: Fixing device
105: fixing belt
400: sheets entrance
500: sheet exit
TH: thermistor
A: control circuit
Wp-max: Maximum image width
P: sheet
S: toner
α Dust Reduction Ratio
D: Distance between belt and filter
Fs: filter area

The invention claimed is:

1. An image forming apparatus comprising:

an image forming portion configured to form an image on a recording material using toner containing parting material;

a heating rotatable member and a pressing rotatable member configured to form a nip portion for fixing the image formed on the recording material by said image forming portion;

a duct configured to discharge air taken in from a neighborhood of an entrance of the nip portion through an air inlet port;

a filter provided in the air inlet port and configured to collect fine particles produced from the parting material; and a fan configured to generate an air flow in said duct, wherein a distance between the air inlet port and said heating rotatable member is d (mm), an area of said filter is Fs ($cm^2$), and an air flow speed through said filter is Fv (cm/s) satisfy the following:

$$(1.25 \times d - 8.67) \times \frac{1000}{Fv \times 60} \leq Fs < 200 \times \frac{1000}{Fv \times 60}.$$

2. An image forming apparatus according to claim 1, which satisfies the following:

$$(2.89 \times d - 22.9) \times \frac{1000}{Fv \times 60} \leq Fs < 200 \times \frac{1000}{Fv \times 60}.$$

3. An image forming apparatus according to claim 1, wherein d (mm) is not less than 5 and not more than 100.

4. An image forming apparatus according to claim 1, wherein Fv (cm/s) is not less than 5 and not more than 30.

5. An image forming apparatus according to claim 1, wherein said filter has an air flow resistance (Pa) of not less than 50 and not more than 130.

6. An image forming apparatus according to claim 1, wherein said filter has a curved shape in which a central portion thereof in a lateral direction protrudes toward an inside of said duct.

7. An image forming apparatus according to claim 1, wherein a width of said filter is not less than a width of the recording material having a minimum width usable with the image forming apparatus.

8. An image forming apparatus according to claim 1, wherein said filter comprises electrostatic nonwoven fabric.

9. An image forming apparatus according to claim 1, wherein the air inlet port is disposed in a range from a position where the image is formed on the recording material by said image forming portion to the nip portion in a feeding direction of the recording material.

10. An image forming apparatus comprising:

an image forming portion configured to form an image on a recording material using toner containing parting material;

a heating rotatable member and a pressing rotatable member configured to form a nip portion for fixing the image formed on the recording material by said image forming portion;

a duct configured to discharge air taken in from neighborhood of an entrance of the nip portion through an air inlet port;

a filter provided in the air flow path in said duct to collect fine particles produced from the parting material;

a fan configured to generate an air flow in said duct, wherein a distance between said filter and said heating rotatable member is d (mm), an area of said filter is Fs ($cm^2$), and an air flow speed through said filter is Fv (cm/s) satisfy the following:

$$(1.25 \times d - 8.67) \times \frac{1000}{Fv \times 60} \leq Fs < 200 \times \frac{1000}{Fv \times 60}.$$

11. An image forming apparatus according to claim 10, which satisfies the following:

$$(2.89 \times d - 22.9) \times \frac{1000}{Fv \times 60} \leq Fs < 200 \times \frac{1000}{Fv \times 60}.$$

12. An image forming apparatus according to claim 10, wherein d (mm) is not less than 5 and not more than 100.

13. An image forming apparatus according to claim 10, wherein Fv (cm/s) is not less than 5 and not more than 30.

14. An image forming apparatus according to claim 10, wherein said filter has an air flow resistance (Pa) of not less than 50 and not more than 130.

15. An image forming apparatus according to claim 14, wherein said filter has a curved shape in which a central portion thereof in a lateral direction protrudes toward an inside of said duct.

16. An image forming apparatus according to claim 10, wherein a width of said filter is not less than a width of the recording material having a minimum width usable with the image forming apparatus.

17. An image forming apparatus according to claim 10, wherein said filter comprises electrostatic nonwoven fabric.

18. An image forming apparatus according to claim 10, wherein the air inlet port is disposed in a range from a position where the image is formed on the recording material by said image forming portion to the nip portion in a feeding direction of the recording material.

* * * * *